US006657368B1

(12) United States Patent
Kosaka et al.

(10) Patent No.: US 6,657,368 B1
(45) Date of Patent: Dec. 2, 2003

(54) ELECTRON BEAM DEVICE, METHOD FOR PRODUCING CHARGING-SUPPRESSING MEMBER USED IN THE ELECTRON BEAM DEVICE, AND IMAGE FORMING APPARATUS

(75) Inventors: Yoko Kosaka, Atsugi (JP); Masahiro Fushimi, Zama (JP); Hideaki Mitsutake, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 71 days.

(21) Appl. No.: 09/722,720

(22) Filed: Nov. 28, 2000

Related U.S. Application Data

(63) Continuation of application No. PCT/JP99/04872, filed on Sep. 8, 1999.

(30) Foreign Application Priority Data

Sep. 8, 1998 (JP) ..... 10-254343
Oct. 7, 1998 (JP) ..... 10-285763

(51) Int. Cl.[7] ..... H01J 1/00
(52) U.S. Cl. ..... 313/310; 313/495; 313/292
(58) Field of Search ..... 313/495, 496, 313/497, 292, 310

(56) References Cited

U.S. PATENT DOCUMENTS 5,227,691 A * 7/1993 Murai et al. ..... 313/497
5,561,340 A * 10/1996 Jin et al. ..... 313/497
5,569,974 A 10/1996 Morikawa et al. ..... 313/310

(List continued on next page.)

FOREIGN PATENT DOCUMENTS

EP 0725418 8/1996
JP 57 118355 7/1982
JP 02 2257551 10/1990
JP 3 55738 3/1991
JP 3 49135 7/1991
JP 4 28137 1/1992
JP 2000149832 A * 5/2000 ..... H01J/29/87

OTHER PUBLICATIONS

Dittmer; "Electrical Conduction And Electron Emission of Discontinuous Thin Films"; Thin Solid Films, vol. 9, (1972) pp. 317–328.
Mead; "Operation of Tunnel–Emission Devices"; J. Appl. Phys., vol. 48, No. 4, pp. 646–652 (1961).
Spindt, et al.; "Physical Properties of Thin–Film Field Emission Cathodes With Molybdenum Cones"; J. Appl. Phys., vol. 47, No. 12, pp. 5248–5263 (1976).

(List continued on next page.)

*Primary Examiner*—Nimeshkumar D. Patel
*Assistant Examiner*—Mariceli Santiago
(74) *Attorney, Agent, or Firm*—Fitzpatrick, Cella, Harper & Scinto

(57) ABSTRACT

There are provided an electron beam device which has an atmospheric pressure-resistant member such as a spacer interposed between an electron source and a member to be irradiated with electrons, and can suppress charge on the member, a charging-suppressing member, and its producing method. An electron beam device having an electron source for emitting electrons, a member to be irradiated with the electrons, and a first member interposed between the electron source and the member to be irradiated is characterized in that the surface of the first member has a three-dimensional shape, and projecting portions of the three-dimensional shape form a network shape. In addition, an electron beam device having an electron source for emitting electrons, a member to be irradiated with the electrons, and a first member interposed between the electron source and the member to be irradiated is characterized in that the surface of the first member has a three-dimensional shape, and the three-dimensional shape has recessed portions continuously surrounded by projecting portions.

51 Claims, 21 Drawing Sheets

U.S. PATENT DOCUMENTS

| | | | | | |
|---|---|---|---|---|---|
| 5,598,056 | A | | 1/1997 | Jin et al. | 313/495 |
| 5,682,085 | A | | 10/1997 | Suzuki et al. | 315/169.1 |
| 5,690,530 | A | | 11/1997 | Jin et al. | 445/24 |
| 5,726,529 | A | * | 3/1998 | Dean et al. | 313/292 |
| 5,811,919 | A | | 9/1998 | Hoogsteen et al. | 313/422 |
| 5,939,822 | A | * | 8/1999 | Alderson | 313/496 |
| 6,153,973 | A | * | 11/2000 | Shibata et al. | 313/495 |
| 6,222,313 | B1 | * | 4/2001 | Smith et al. | 313/292 |

OTHER PUBLICATIONS

Meyer, et al; "Recent Development On 'Microtips' Display at Leti"; Tech. Dig. of IVMC 91, Nagahama 1991 (pp. 6–9).

Cross, et al; "The Effect Of Cuprous Oxide Coatings on Surface Flashover of Dielectric Spacers in Vacuum"; IEEE Trans. On Elec. Insl., Vo. E1–9, No. 4, (1974) pp. 146–150.

Araki, et al; "Electroforming and Electron Emission of Carbon Thin Films"; J. Vac. Soc. Japan, vol. 26, No. 1, 22–29 (1981).

Hartwell, et al; "Strong Electron Emission From Patterned Tin–Indium Oxide Thin Films"; Tech. Dig. 1975, Int. Elec. Dev. Mtg., Dec. 1–3, 1975, pp. 519–521.

Elinson, et al; "The Emission Of Hot Electron And The Field Emission Of Electrons From Tin Oxide"; Radio Eng. & Electronic Phys., vol. 10, pp. 1290–1296 (1965).

Dyke, et al; "Field Emission" Advances in Electronics and Electron Physics, vol. VIII, pp. 90–184 (1956).

* cited by examiner (a)

(b)

ELECTRON BEAM DEVICE, METHOD FOR PRODUCING CHARGING-SUPPRESSING MEMBER USED IN THE ELECTRON BEAM DEVICE, AND IMAGE FORMING APPARATUS

This application is a continuation of International Application No. PCT/JP99/04872, filed on Sep. 8, 1999, which claims the benefit of Japanese Patent Applications No. 10-254343, filed on Sep. 8, 1998 and No. 10-285763, filed on Oct. 7, 1998.

TECHNICAL FIELD

The present invention relates to an electron beam device and, more particularly, to an electron beam device having a spacer for maintaining the interval between an electron source and a member to be irradiated with electrons, a method for producing a charging-suppressing member used in the electron beam device, and an image forming apparatus.

BACKGROUND ART

Conventionally, electron-emitting elements are mainly classified into two types of elements: a thermionic cathode element and cold cathode element. Of these elements, the thermionic cathode element is used in a cathode ray tube and the like. Known examples of the cold cathode element are surface-conduction type electron-emitting elements, field emission type electron-emitting elements (to be referred to as FE type electron-emitting elements hereinafter), and metal/insulator/metal type electron-emitting elements (to be referred to as MIM type electron-emitting elements hereinafter).

The surface-conduction type electron-emitting element utilizes the phenomenon that electrons are emitted from a small-area thin film formed on a substrate by flowing a current parallel through the film surface. The surface-conduction type electron-emitting element includes an electron-emitting element using an $SnO_2$ thin film by Elinson [M. I. Elinson, Radio Eng. Electron Phys., 10, 1290, (1965)], an electron-emitting element using an Au thin film [G. D Mitter, "Thin Solid Films", 9,317 (1972)], an electron-emitting element using an $In_2O_3/SnO_2$ thin film [M. Hartwell and C. G. Fonstad, "IEEE Trans. ED Conf.", 519 (1975)], and an electron-emitting element using a carbon thin film [Hisashi Araki et al., Vacuum, Vol. 26, No. 1, 22 (1983)].

FIG. 24 is a plan view showing an element by M. Hartwell et al. described above as a typical example of the element structures of these surface-conduction type electron-emitting elements. In FIG. 24, reference numeral 1 denotes a substrate; and 2, a conductive thin film made of a metal oxide formed by sputtering. This conductive thin film 2 has an H-shaped pattern, as shown in FIG. 24. The conductive thin film 2 undergoes electrification processing called electrification forming to form an electron-emitting portion 3.

In electrification forming, a constant DC voltage or a DC voltage which rises at a very low rate of, e.g., 1 V/min is applied between the two ends of the conductive thin film 2 to partially destroy or deform the conductive thin film 2, thereby forming the electron-emitting portion 3 with an electrically high resistance. Note that the destroyed or deformed part of the conductive thin film 2 forms a fissure. When an appropriate voltage is applied to the conductive thin film 2 after electrification forming, electrons are emitted by the electron-emitting portion 3 near the fissure.

After electrification forming processing, a voltage pulse is periodically applied in a vacuum atmosphere as electrification activation processing, thereby depositing on the electron-emitting portion 3 carbon or a carbon compound derived from an organic compound present in the vacuum atmosphere. This electrification activation processing enhances a stable electron emission effect.

Known examples of the FE type electron-emitting element are described in W. P. Dyke & W. W. Dolan, "Field Emission", Advance in Electron Physics, 8, 89 (1956) and C. A. Spindt, "Physical Properties of Thin-Film Field Emission cathodes with molybdenium Cones", J. Appl. Phys., 47, 5248 (1976).

FIG. 24 is a sectional view showing an element by C. A. Spindt et al. described above as a typical example of the element structure of the FE type electron-emitting element. In FIG. 24, reference numeral 4 denotes a substrate; 5, an emitter wiring line made of a conductive material; 6, an emitter cone made of molybdenum or the like; 7, an insulating layer; and 8, a gate electrode. This electron-emitting element emits electrons toward a high-voltage electrode arranged above the element by applying a proper voltage between the emitter cone 6 and the gate electrode 8, and emitting a field from the distal end of the emitter cone 6.

As another element structure of the FE type electron-emitting element, in addition to the stacked structure having a conical shape as shown in FIG. 24, an emitter and gate electrode are arranged on a substrate to be almost parallel to the substrate plane.

A known example of the MIM type electron-emitting element is described in C. A. Mead, "Operation of Tunnel-Emission Devices, J. Appl. Phys., 32,646 (1961). FIG. 25 shows a typical example of the element structure of the MIM type electron-emitting element. FIG. 25 is a sectional view. In FIG. 25, reference numeral 9 denotes a substrate; 10, a lower electrode made of a metal; 11, an insulating layer as thin as about 100 Å; and 12, an upper electrode made of a metal with a thickness of about 80 to 300 Å. The MIM type electron-emitting element emits electrons from the surface of the upper electrode 12 by applying a proper voltage between the upper electrode 12 and the lower electrode 10.

Compared to a thermionic cathode element, various cold cathode elements described above can emit electrons at a low temperature, and does not require any heater. Thus, the cold cathode element has a simpler structure than the thermionic cathode element, and can form a small element. Even if many elements are arranged on a substrate at a high density, problems such as thermal melting of the substrate hardly arise. In addition, the response speed of the thermionic cathode element is low because it operates upon heating by a heater, whereas the response speed of the cold cathode element is high.

As applications of cold cathode elements, there are image forming apparatuses such as an image display apparatus and image recording apparatus, charge beam sources, and the like.

Particularly as applications of cold cathode elements to an image display apparatus, as disclosed in U.S. Pat. No. 5,066,883 by the present applicant and Japanese Patent Application Laid-Open Nos. 2-257551 and 4-28137, an image display apparatus using a combination of a surface-conduction type electron-emitting element and a fluorescent substance which is irradiated with an electron beam to emit light has been studied. That is, there is an image display apparatus using a combination of a surface-conduction type electron-emitting element and a fluorescent substance which is irradiated with an electron beam to emit light has been studied.

A known application of FE type electron-emitting elements to an image display apparatus is a flat display apparatus reported by R. Meyer et al. [R. Meyer: "Recent Development on Microtips Display at LETI", Tech. Digest of 4th Int. Vacuum Micro-electronics Conf., Nagahama, pp. 6 to 9 (1991)].

An application of many MIM type electron-emitting elements arranged side by side to an image display apparatus is disclosed in Japanese Patent Application Laid-Open No. 3-55738 by the present applicant.

Of these electron-emitting elements, the surface-conduction type electron-emitting element has a simple structure and can be easily manufactured, and many elements can be easily formed in a wide area.

An image display apparatus using a combination of a surface-conduction type electron-emitting element and fluorescent substance is superior to a liquid crystal display apparatus in that the image display apparatus does not require any backlight because of self-emission type and that the view angle is wide.

In a flat image display apparatus, many electron-emitting elements are arranged on a flat substrate, and fluorescent substances for emitting light by electrons are arranged to face the electron-emitting elements. The electron-emitting elements are arrayed in a two-dimensional matrix (to be referred to as a multi electron source), and each element is connected to a row-direction wiring line and column-direction wiring line. An example of the image display method is the following simple matrix driving.

To emit electrons from an arbitrary row in the matrix, a selection voltage is applied in the row direction, and a signal voltage is applied to column wiring lines in synchronism with this.

Electrons emitted by the electron-emitting elements of the selected row are accelerated toward the fluorescent substances to excite the fluorescent substances and emit light. By sequentially applying the selection voltage in the row direction, an image is displayed.

The space between a substrate (rear plate) on which electron-emitting elements are formed in a two-dimensional matrix, and a substrate (face plate) on which fluorescent substances and an acceleration electrode are formed must be maintained in vacuum. Since the atmospheric pressure acts on the rear plate and face plate, the display apparatus requires a substrate thick enough to resist the atmospheric pressure as the display apparatus becomes bulky. However, this increases the weight. For this reason, the apparatus adopts a structure in which support members (spacers) are interposed between the rear plate and the face plate to keep the interval between the rear plate and the face plate constant and to prevent damage to the rear plate and face plate.

The spacer must have a mechanical strength enough to resist the atmospheric pressure, but does not greatly influence the orbit of electrons traveling between the rear plate and the face plate. The cause of influencing the electron orbit is charge of the spacer. The spacer is charged because some of electrons emitted by the electron source or secondary electrons reflected by the face plate are incident on the spacer, the spacer further emits secondary electrons, or ions ionized by collision of electrons attach to the surface.

If the spacer is positively charged, electrons traveling near the spacer are attracted to the spacer, and thus a display image is distorted near the spacer. The influence of charge becomes more typical as the interval between the rear plate and the face plate increases.

As a general means of suppressing charge, the charged surface is rendered conductive, and a small current is flowed to remove electric charges. A method of applying this concept to the spacer and covering the spacer surface with tin oxide is disclosed in Japanese Patent Application Laid-Open No. 57-118355. Japanese Patent Application Laid-Open No. 3-49135 discloses a method of covering the spacer surface with a PdO-based glass material.

High luminance is an important factor for the image display apparatus. To efficiently emit light from fluorescent substances formed on the face plate, the fluorescent substances are irradiated with electrons accelerated at a high voltage. To emit light with high efficiency, the height of the spacer is set to about 1 to 8 mm, and the acceleration electrode voltage is set to 3 kV or more, and desirably 5 kV or more. Therefore, a voltage of several kV or more is applied between the rear plate and the face plate, and a voltage of almost the same potential is applied across the spacer. The material used for the spacer is required not to discharge upon application of the acceleration voltage.

As a means of increasing the creeping discharge pressure resistance, the surface is effectively covered with a material having a low secondary electron emission ratio. Known examples of covering the surface with a material having a low secondary electron ratio use chromium oxide (T. S. Sudarshan and J. D. Cross: IEEE Tran. EI-11, 32 (1976)) and copper oxide (J. D. Cross and T. S sudarshan: IEEE Tran. EI-9146 (1974)).

As prior arts relating to the spacer, U.S. Pat. No. 5,598,056, U.S. Pat. No. 5,690,530, U.S. Pat. No. 5,561,340, U.S. Pat. No. 5,811,919, and EPA 1725418 are known.

As described above, spacers have been extensively developed to solve the functional problems relating to the spacers. The invention according to the present application has as its object to implement a suitable electron beam device using a developed spacer. In particular, it is another object of the invention to implement an arrangement capable of suppressing charge on a first member when a member such as a spacer is interposed between an electron source and a member to be irradiated with electrons in an electron beam device.

It is still another object of the present invention to implement an arrangement capable of desirably rendering at least a portion of the first member near the surface conductive when a member such as a spacer is interposed between an electron source and a member to be irradiated with electrons. It is still another object of the present invention to realize a spacer suitable for an image forming apparatus represented by an image display apparatus in which electrons emitted by an electron source are accelerated at a potential having a potential difference of 3 kV or more from the potential of the electron source, and the electrons cause fluorescent substances to emit light.

DISCLOSURE OF THE INVENTION

One invention of an electron beam device according to the present application has the following arrangement.

According to the present invention, an electron beam device having an electron source for emitting electrons, a member to be irradiated with the electrons, and a first member interposed between the electron source and the member to be irradiated is characterized in that a surface of the first member has a three-dimensional shape, and projecting portions of the three-dimensional shape form a network shape.

According to another invention of an electron beam device according to the present application, an electron beam device having an electron source for emitting electrons, a member to be irradiated with the electrons, and a first member interposed between the electron source and the member to be irradiated is characterized in that a surface of the first member has a three-dimensional shape, and the three-dimensional shape has recessed portions each continuously surrounded by projecting portions.

The three-dimensional shape is constituted by a film formed on a substrate of the first member. The three-dimensional shape may be constituted by a plurality of films formed on a substrate of the first member. The three-dimensional shape is constituted by a film formed on a substrate of the first member and a film from which part of an underlayer of the film is exposed.

The underlayer of the film from which part of the underlayer is exposed is preferably conductive. In particular, the underlayer preferably includes a conductive film formed on the substrate. The conduction is preferably semiconduction. Exposure of the underlayer means electronic exposure. More specifically, the underlayer is determined to be exposed when the structure of a spacer surface is evaluated as an evaluation means at an acceleration voltage of 1 kV and an incident angle of 75° to confirm a crystal grain boundary, axiality, or the like that matches the structure of the underlayer (lower layer) on an SEM (Scanning Electron Microscope) image.

In an arrangement using the film from which part of the underlayer is exposed, the first member preferably has a 100 $\mu$m×100 $\mu$m-region in which a value obtained by dividing a covering area of the film from which part of the underlayer is exposed by an exposure area of the underlayer is not less than ⅓ and not more than 100. The first member preferably has a 100 $\mu$m×100 $\mu$m-region in which an average value of an area of each portion from which part of the underlayer is exposed is not more than 5,000 $\mu m^2$. The first member preferably has a 100 $\mu$m×100 $\mu$m-region in which an average value of a width of each portion from which part of the underlayer is exposed is not more than 70 $\mu$m.

The film from which part of the underlayer is exposed may include an insulating film. When the underlayer is conductive, the film from which part of the underlayer is exposed need not be conductive even if the first member is to be rendered conductive to some degree. This increases the degree of freedom of choice of the material. The resistance value of the film from which part of the underlayer is exposed is a volume resistance of $10^4$ Ωm or more to $10^8$ Ωm or less.

Further, an arrangement can be adopted in which a secondary electron emission coefficient of the film from which part of the underlayer is exposed is smaller than a secondary electron emission coefficient of the underlayer. In the above invention, for example, the first member includes a spacer for maintaining an interval between the electron source and the member to be irradiated.

The above invention can be more preferably applied to a case wherein the first member includes a member arranged at a position which, when the first member is charged, substantially changes by charge an orbit of electrons emitted by the electron source.

A charging-suppressing member producing method which suppresses charge according to the present invention comprises the following invention as a method of manufacturing a member whose charge is suppressed. A charging-suppressing member producing method which particularly suppresses charge of a spacer is characterized by comprising the step of forming on a substrate a film from which part of an underlayer is exposed, the step comprising applying a material of the film in a liquid state.

BEST MODE FOR CARRYING OUT THE INVENTION

An embodiment according to the present invention will be described in detail with reference to the accompanying drawings.

[Display Panel of Image Forming Apparatus]

Figure 3:
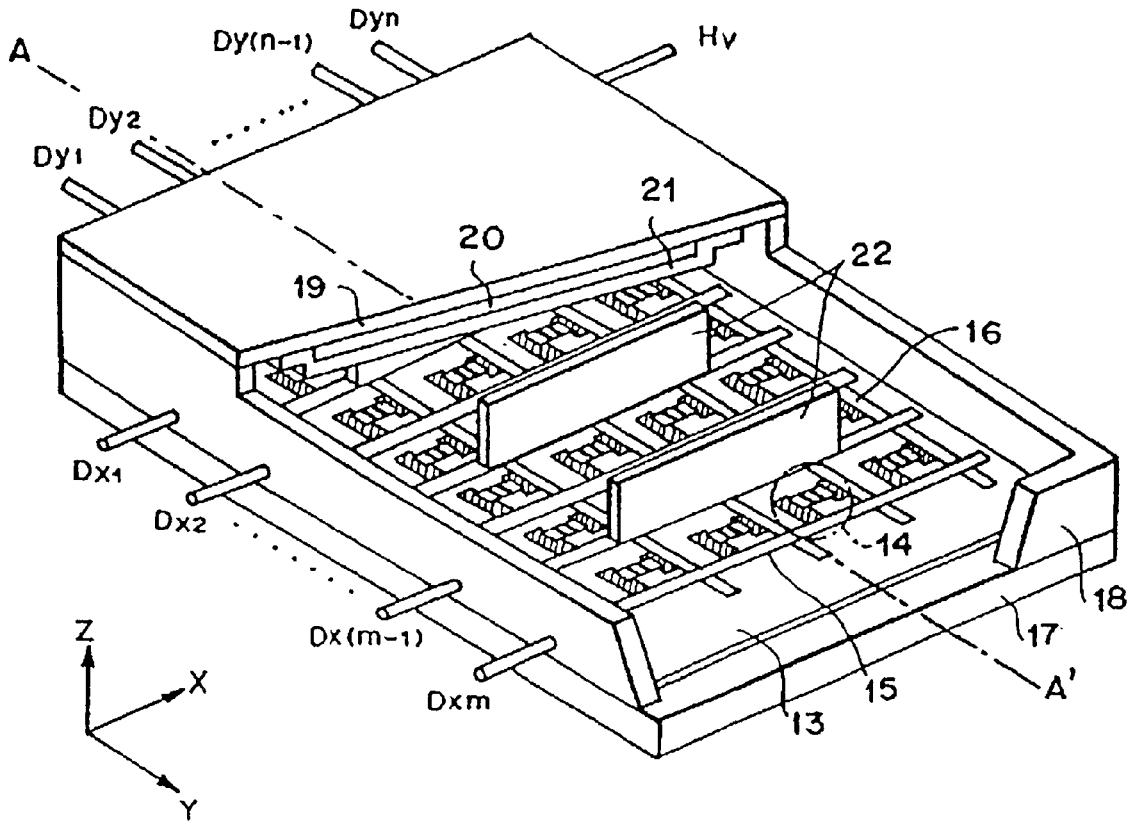
FIG. 3 is a partially cutaway perspective view showing the display panel of the image display apparatus as the embodiment of the present invention.

FIG. 3 is a perspective view showing a display apparatus as an application of an image display apparatus according to the embodiment, in which a panel is partially cut away in order to show the internal structure. In FIG. 3, reference numeral 13 denotes a substrate on which an electron-emitting portion is formed; 14, an electron-emitting element having an electron-emitting portion; 15, a row-direction wiring line along the x-axis for application to the electron-emitting element 14; 16, a column-direction wiring line along the y-axis for application to the electron-emitting element 14; 17, a rear plate; 18, a side wall; and 19, a face plate. Reference numerals 17 to 19 form an airtight container for maintaining a vacuum in the display panel. Reference numeral 20 denotes a fluorescent substance as a light-emitting material formed in the face plate 19; and 21, a metal back as a high-voltage electrode for attracting an electron flow.

In assembling the airtight container, the respective members must be sealed to obtain a sufficient strength and maintain the airtight condition. For example, frit glass is applied to joint portions, and baked at 400 to 500° C. for 10 min or more in air or a nitrogen atmosphere to seal the members. A method of evacuating the interior of the airtight container will be described below. Since the interior of the airtight container is kept in a vacuum of about $10^{-4}$ Pa, a spacer 22 is arranged as an atmospheric pressure-resistant structure in order to prevent destruction of the airtight container by the atmospheric pressure or sudden shocks.

[Spacer in Display Panel]

Figure 1:
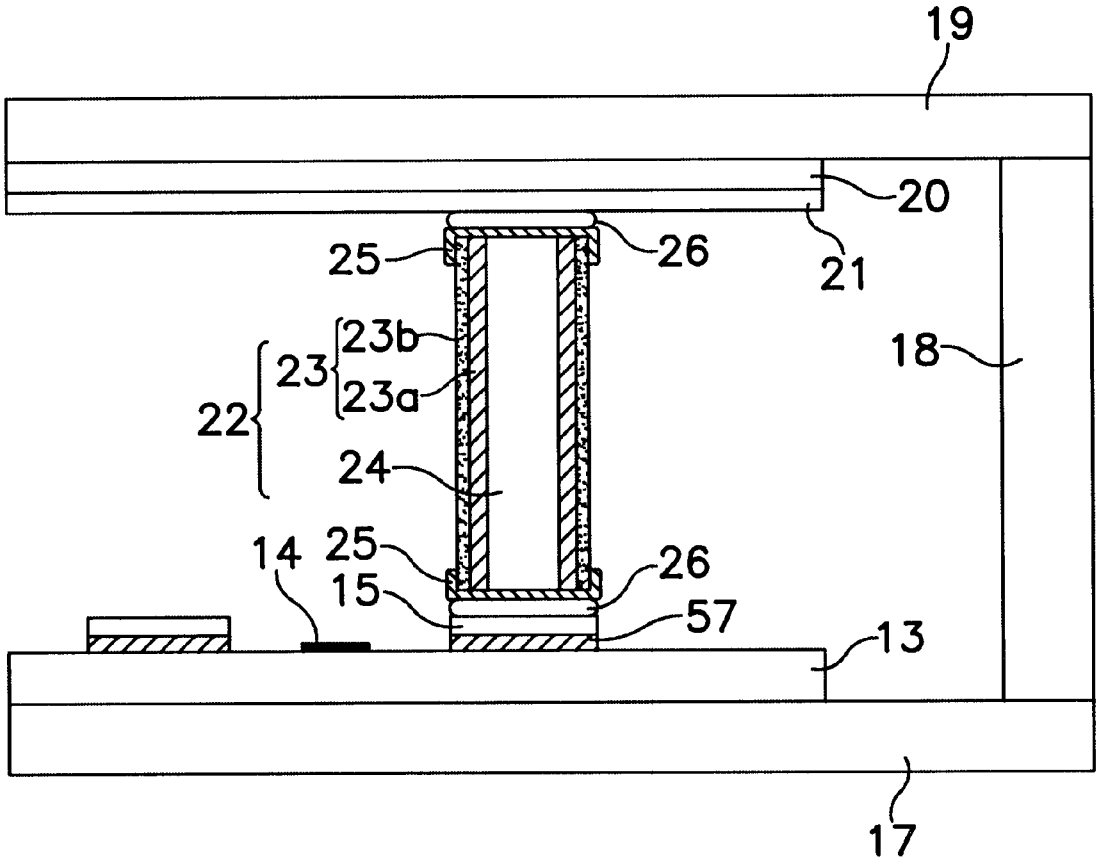
FIG. 1 is a schematic sectional view of the vicinity of the spacer of an image display apparatus as an embodiment of the present invention.

The arrangement and manufacturing method of the display panel of the image display apparatus to which the present invention is applied will be exemplified. FIG. 1 is a schematic sectional view of the display apparatus mainly showing the spacer 22. The same reference numerals as in FIG. 3 denote the same parts, and a repetitive description thereof will be omitted. In FIG. 1, reference numeral 13 denotes the substrate; 14, a cold cathode electron source; 17, the rear plate; 18, the side wall; and 19, the face plate. Reference numerals 17 to 19 constitute an envelope to form an airtight container for maintaining a vacuum in the display panel.

On the rear plate 17, the row-direction wiring line 15 is formed on an insulating layer 57. The face plate 19 is constituted by the fluorescent substance 20 formed from a transparent glass base, and the metal back 21 serving as a high-voltage electrode. A transparent electrode of ITO or the like and a fluorescent substance may be stacked on the transparent glass base. This embodiment will exemplify the fluorescent substance 20. The spacer 22 is made up of an insulating base 24, a first layer 23*a* covering the insulating base 24, and a second layer 23*b* on the first layer 23*a*. On the rear plate 17 side, the lower portion of the spacer 22 is covered with a low-resistance film 25, and the spacer 22 is bonded and fixed to the row-direction wiring line 15 with a conductive adhesive 26. On the face plate 19 side, the upper portion of the spacer 22 is covered with a low-resistance film 25, and the spacer 22 is bonded and fixed to the metal back 21 with the conductive adhesive 26.

The spacer 22 is interposed to prevent damage or deformation of the envelope by the atmospheric pressure applied particularly between the rear plate 17 and the face plate 19 after the interior of the envelope is evacuated. The material, shape, arrangement, and number of spacers 22 to be arranged are determined in consideration of the shape, size, and thermal expansion coefficient of the envelope, the atmospheric pressure applied to the envelope, heat, and the like. The shape of the spacer 22 is a flat panel shape, cross shape, L shape, cylindrical shape, or matrix shape.

The insulating base 24 serving as a base in the spacer 22 is desirably made of a material having almost the same thermal expansion characteristic as those of the rear plate 17 having electron-emitting elements and the face plate 19 having the fluorescent substances 20. Alternatively, the insulating base 24 may be made of a material which has a high elasticity and easily absorbs thermal deformation. To resist the atmospheric pressure applied to the face plate 19 and rear plate 17, a material such as glass or ceramics having a high mechanical strength and high heat resistance is suitable. When glass is used as the material of the face plate 19 and rear plate 17, the insulating base 24 of the spacer 22 is desirably made of the same material or a material having the same thermal expansion coefficient in order to suppress thermal stress during the manufacture of a display apparatus.

[Spacer]

The inventor of the present application has examined an arrangement for suppressing charge of the spacer 22 to find that charge can be suppressed when recesses and projections are formed on the spacer surface, and particularly the projecting portions form a network shape, or the surface has recessed portions continuously surrounded by projecting portions. In this case, the network shape means a state in which projecting portions link with each other to give the surface a net-like structure, porous structure, or sponge structure. In the invention of the present application, recessed portions are preferably surrounded by projecting portions so as to continuously draw a contour line at a height of at least 100 nm from the deepest portion of the recessed portion when the contour line is drawn in a three-dimensional shape.

The network structure is effective for suppressing charge. Although the network structure exhibits the effect even when the height around a recessed portion is small, the network is preferably comprised of projecting portions having a height of 100 nm or more from the deepest portion of a recessed portion surrounded by projecting portions in a network shape. In particular, the network structure according to the invention of the present application or a recessed portion surrounded by projecting portions is preferably formed in at least a region which is readily charged, and more preferably recessed portions exist distributively. More specifically, a state in which when a section is viewed along two axes which are parallel to the surface and are perpendicular to each other, recesses and projections are formed along either axis is preferably implemented regardless of the two axes set to any directions parallel to the plane of the spacer surface. The spacer surface desirably has a 100 $\mu$m×100 $\mu$m-region including a plurality of recessed portions.

The inventor of the present application has found that an arrangement is especially preferable in which at least projecting portions in the three-dimensional shape have a different composition from that of the underlayer of a layer which forms the recesses and projections, and the underlayer is exposed from recessed portions. In particular, a film of a composition containing a material having a low secondary electron emission efficiency such as $Cr_2O_3$, $Nb_2O_5$, or $Y_2O_3$ which can be used for the second layer is very effective.

Figure 2:
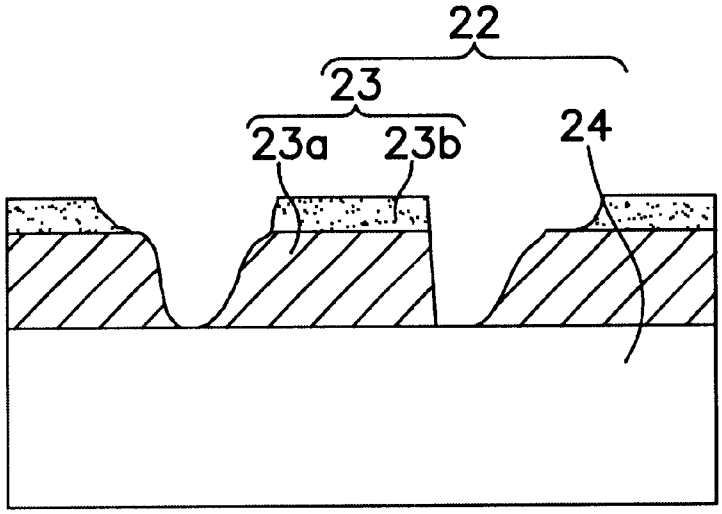
FIG. 2 is a schematic sectional view of the spacer used in the present invention.

FIG. 2 is a schematic view showing the structure of the spacer 22. The semiconductive first layer 23*a* and the second layer 23*b* as an oxide insulating layer or semiconductive layer are formed on the insulating base 24 of glass or the like.

The first layer 23*a* removes electric charges on the surface of the spacer 22 to prevent the spacer 22 from being greatly charged. The second layer 23*b* is made of a material having a low secondary electron emission efficiency to suppress charge. Both the first layer 23*a* and second layer 23*b* suppress emission of secondary electrons on the spacer 22. The structure of the second layer 23*b* is preferably a network structure in which the area of a portion where the first layer 23*a* is exposed and the area of a portion covered with the second layer 23*b* have a ratio of 3:1 or more to 1:100 or less, or a mixed state of an island-like structure and network structure. Further, it is desirable that when an arbitrary 100 $\mu$m×100 $\mu$m-region is observed, the exposed surface of the first layer 23*a* and the second layer 23*b* coexist. When the second layer 23*b* of this embodiment has the network structure, the average value of the area of one exposed portion is 5,000 $\mu m^2$ or less, and preferably 2,500 $\mu m^2$ or less. When the second layer 23*b* has the network structure or a mixed state of the island-like structure and network structure, the average value of the width of the exposed portion is 70 $\mu$m or less, and preferably 50 $\mu$m or less.

In this embodiment, an expression "the network structure" or "a mixture of the network structure and island-like structure" means the exposed portion of the first layer 23*a* and the structure of the second layer 23*b*. More specifically, this expression means shapes as shown in FIGS. 13 to 16. If the shape is represented mainly by the structure of the second layer 23*b*, the shape is expressed by the network structure or a mixture of the network structure and island-like structure. Alternatively, the shape may be expressed by a porous structure, sponge structure, or net-like structure. That is, it suffices that recessed portions surrounded by projecting portions scatter and the projecting portions link with each other.

The resistance value of the first layer 23*a* is set to a value at which a current enough to quickly remove electric charges without charging the surface of the spacer 22 flows through the spacer 22. Hence, a resistance value suitable for the spacer 22 is set by the charge amount. The charge amount depends on an emission current from the electron source and the secondary electron emission ratio on the surface of the spacer 22. Since $Cr_2O_3$, $Nb_2O_5$, $Y_2O_3$, or the like contained in the second layer 23*b* is a material having a low secondary electron emission ratio, no large current need be flowed. Although almost all the use conditions can be coped with if the sheet resistance of the first layer 23*a* is $10^{12}\Omega$ or less, a sheet resistance of $10^{11}\Omega$ or less is satisfactory. On the other hand, the lower limit of the resistance value is limited by power consumption on the spacer 22, and the power consumption of the whole image display apparatus does not excessively increase. Hence, a value which does not greatly influence heat generation of the whole apparatus must be selected as the resistance of the spacer 22. In general, a material having a resistivity of $10^{-6}$ $\Omega$·m or less is called a conductor, and a material having a resistivity of $10^8$ $\Omega$·m or more is called an insulator. The resistivity of the first layer 23*a* is set as a semiconductive material within the range of $10^{-6}$ $\Omega$·m or more to $10^8$ $\mu$·m or less.

The first layer 23*a* and second layer 23*b* used for the spacer 22 desirably use a material having a positive temperature coefficient of resistance or even if it is negative, having an absolute value of 1%/C°. When the temperature coefficient of resistance of the spacer 22 is positive, the resistance value increases along with temperature rise, which suppresses heat generation of the spacer 22. To the contrary, if the temperature coefficient of resistance is negative, the resistance value decreases owing to temperature rise caused by power consumed on the surface of the spacer 22, which causes so-called thermal runaway in which heat is further generated, and the temperature continuously rises to flow an excessive current. However, in a situation in which the heat value, i.e., power consumption and heat dissipation are balanced, no thermal runaway occurs. From this, if the absolute value of the temperature coefficient of resistance (TCR) is small, thermal runaway hardly occurs.

It has been experimentally confirmed that, if power consumption per 1 $cm^2$ of the spacer exceeds almost 0.1 W with the use of a thin film whose temperature coefficient of resistance (TCR) is about −1%, a current flowing through the spacer 22 continuously increases to cause a thermal runaway state. This depends on the shape of the spacer 22, a voltage Va applied between spacers, and the temperature coefficient of resistance of an antistatic film. From the above conditions, the value of Rs at which power consumption does not exceed 0.1 W per 1 $cm^2$ is $10\times Va^2$ $\Omega$ or more. That is, the sheet resistance Rs of the first layer 23*a* formed on the spacer 22 is desirably set within the range of $10\times Va^2$ to $10^{11}\Omega$.

A resistivity $\rho$ is the product of the sheet resistance Rs and a film thickness t. From the preferable ranges of Rs and t described above, the resistivity $\rho$ of the antistatic film is desirably $10^{-7}\times Va^2$ $\Omega$m to $10^5$ $\Omega$m. To implement more preferable ranges of the sheet resistance and film thickness, $\rho$ is set to $(2\times10^{-7})\times Va^2$ $\Omega$m to $5\times10^4$ $\Omega$m. The electron acceleration voltage Va on the display is 100 V or more. When fluorescent substances for high-speed electrons that are generally used for a CRT are used for a flat display, a voltage of 3 kV or more is required to obtain a satisfactory luminance. For the acceleration voltage Va=1 kV, the resistivity of the antistatic film preferably falls within the range of 0.1 $\Omega$m to $10^5$ $\Omega$m.

The material of the first layer 23*a* is not particularly limited as far as the resistance value can be adjusted to the preferable range of the spacer 22 described above. A metal, oxide, nitride, and the like can be used.

Referring to FIG. 1, to prevent disturbance of the orbit of electrons emitted by the electron source, it is desirable that the potential distribution between the face plate 19 and the rear plate 17 is uniform, i.e., the resistance values of the spacers 22 are almost equal at almost all the locations. If the potential distribution is disturbed, the direction of electrons which should reach the fluorescent substance 20 near the spacer 22 changes, and the electrons strike an adjacent fluorescent substance 20 to distort an image. A film having the network structure of the present invention or a mixed state structure of the network structure and island-like structure coexists even in an area where the exposed surface of the underlayer and the covered surface are small in area. This is effective for ensuring uniformity of the resistance value and preventing distortion of an image.

The material used for the second layer 23*b* is preferably one having a low secondary electron emission ratio. $Cr_2O_3$, $Nb_2O_5$, $Y_2O_3$, and the like exhibit low secondary emission efficiencies, and are materials preferably used for the second layer 23*b*. According to measurement by the present inventors, the secondary electron emission efficiencies of these materials do not exceed 1.8 at maximum for an incident angle of 0°.

However, these materials are insulators having a resistance value of $10^8$ Ωcm or more in volume resistance, are difficult to remove electric charges, and thus cannot be singly used. If, however, these materials are used as the second layer 23*b* of the two-layered structure according to the present invention, their characteristics can be maximized.

In the above-mentioned embodiment, the structure of the second layer 23*b* is preferably a network structure in which the area of an exposed portion where the underlayer is exposed and the area of a portion covered with the second layer 23*b* have a ratio of 3:1 or more to 1:100 or less, or a mixed state of the network structure and island-like structure. Moreover, it is desirable that when an arbitrary 100 μm×100 μm-range is observed with an STM (Scanning Tunnel Microscope), the exposed surface of the first layer 23*a* and the second layer 23*b* coexist. When the second layer 23*b* of this embodiment has the network structure, the area of one exposed portion is 5,000 $\mu m^2$ or less, and preferably 2,500 $\mu m^2$ or less. When the second layer 23*b* is in a mixed state of the island shape and network structure, the width of the exposed portion is 70 μm or less, and preferably 50 μm or less.

By using SYM-BI05, SYM-CE03, or SYM-Y01 available from Kojundo Chemical Laboratory Co., Ltd. or Needral available from Taki Chemical Co., Ltd., a film having a structure such as a network structure or island shape in which the first layer 23*a* is exposed can be relatively easily formed.

The first layer 23*a* and second layer 23*b* can be formed by a reactive sputtering method, an ion-assisted evaporation method, a CVD method, an ion beam sputtering method, a dipping method, a spinner method, and a spraying method.

[Arrangement and Manufacturing Method of Image Forming Apparatus]

The arrangement and manufacturing method of the display panel of the image display apparatus to which the present invention is applied will be exemplified.

FIG. 3 is a perspective view showing a display apparatus used in the above embodiment, in which the panel is partially cut away in order to show the internal structure.

As will be described again, the substrate 13 is fixed to the rear plate 17, and N×M cold cathode electron-emitting elements 14 are formed on the substrate 13. In this case, N and M are positive integers of 2 or more, and are properly set in accordance with the number of target display pixels. For example, in a display apparatus for high-resolution television display, N=3,000 or more, and M=1,000 or more are preferable. The N×M cold cathode electron-emitting elements 14 are arranged in a simple matrix with M row-direction wiring lines 15 and N column-direction wiring lines 16. A portion constituted by the substrate 13, row-direction wiring lines 15, and column-direction wiring lines 16 will be called a multi electron beam source.

The multi electron beam source used in the image display apparatus according to the present invention is not limited to the material, shape, or manufacturing method of the cold cathode electron-emitting element 14 as far as the electron source is constituted by wiring the cold cathode electron-emitting elements 14 in a simple matrix. Therefore, the multi electron beam source can use cold cathode elements such as surface-conduction type electron-emitting elements, FE type electron-emitting elements, or MIM type electron-emitting elements. The multi electron beam source can be directly formed on the rear plate.

The structure of the multi electron beam source in which surface-conduction type electron-emitting elements (to be described later) are arrayed as the cold cathode electron-emitting elements 14 on the substrate 13 and wired in a simple matrix will be described.

Figure 4:
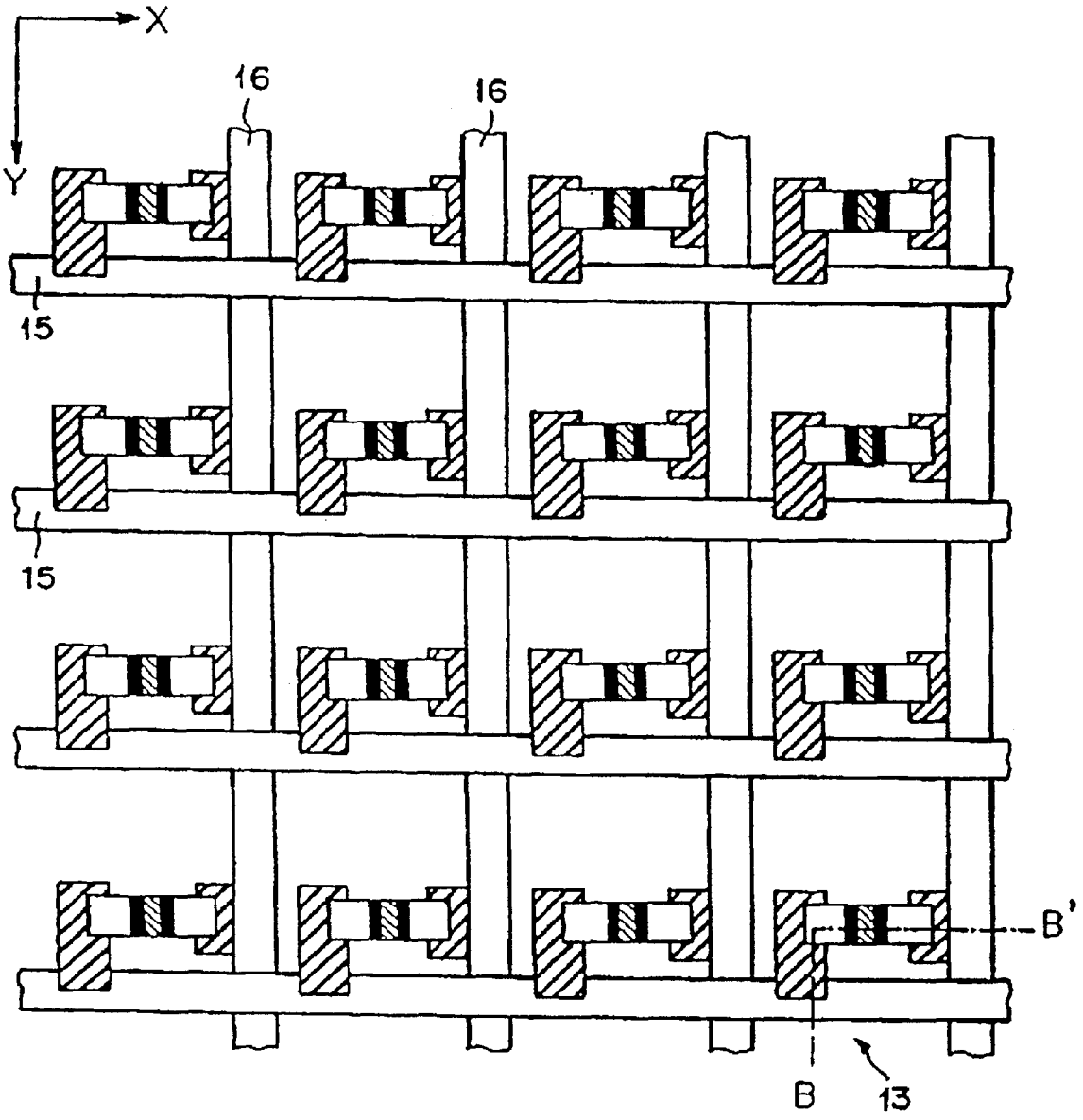
FIG. 4 is a plan view of the substrate of a multi electron beam source used in the embodiment.
Figure 5:
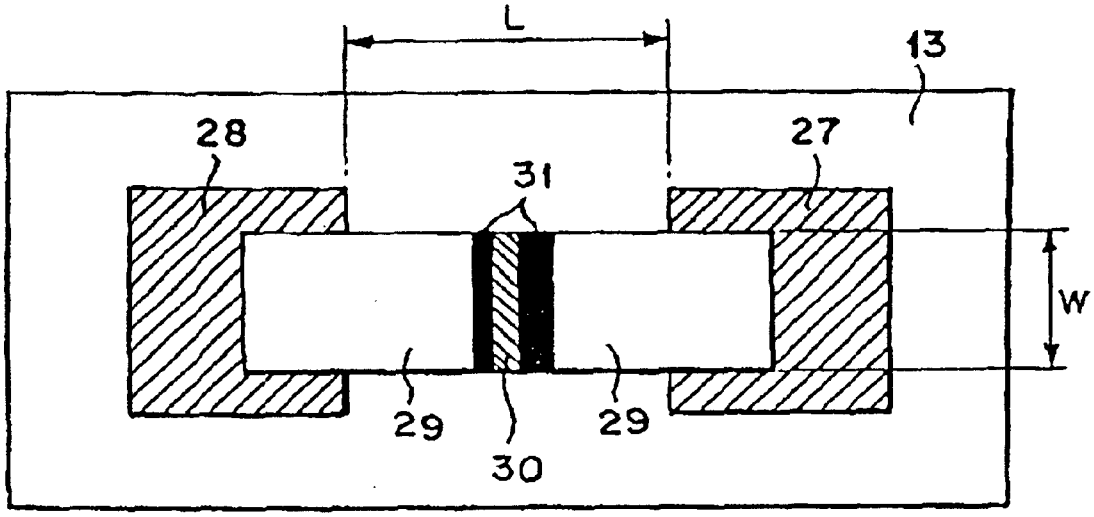
FIGS. 5(*a*) and 5(*b*) are a plan view and sectional view, respectively, of a flat surface-conduction type electron-emitting element used in the embodiment.
Figure 5:
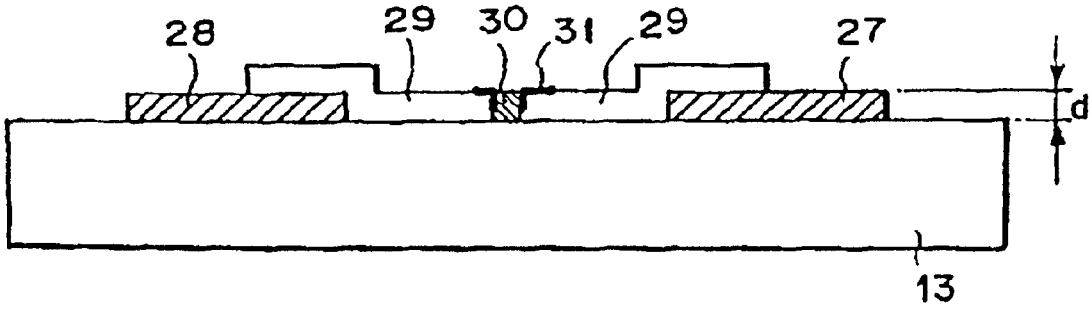

FIG. 4 is a plan view of the multi electron beam source used in the display panel of FIG. 3. Surface-conduction type electron-emitting elements identical to an element (to be described later) shown in FIG. 5 are arrayed on the substrate 13. These elements are wired in a simple matrix by the row-direction wiring electrodes 15 and column-direction wiring electrodes 16. Insulating layers (not shown) are formed between the electrodes at the intersections of the row-direction wiring electrodes 15 and column-direction wiring electrodes 16 to maintain electrical insulation.

FIG. 5(*b*) shows a section taken along the line B–B' in FIG. 4. The multi electron beam source having this structure was manufactured by forming the row-direction wiring electrodes 15, column-direction wiring electrodes 16, insulating layers (not shown) between the electrodes, and the element electrodes and conductive thin films of the surface-conduction type electron-emitting elements on the substrate 13 in advance, and supplying power to the respective elements via the row-direction wiring electrodes 15 and column-direction wiring electrodes 16 to perform electrification forming processing (to be described later) and electrification activation processing (to be described later).

In this embodiment, the substrate 13 of the multi electron beam source is fixed to the rear plate 17 of the airtight container. If, however, the substrate 13 of the multi electron beam source has sufficient strength, the substrate 13 of the multi electron beam source may be used as the rear plate 17 of the airtight container.

Figure 6:
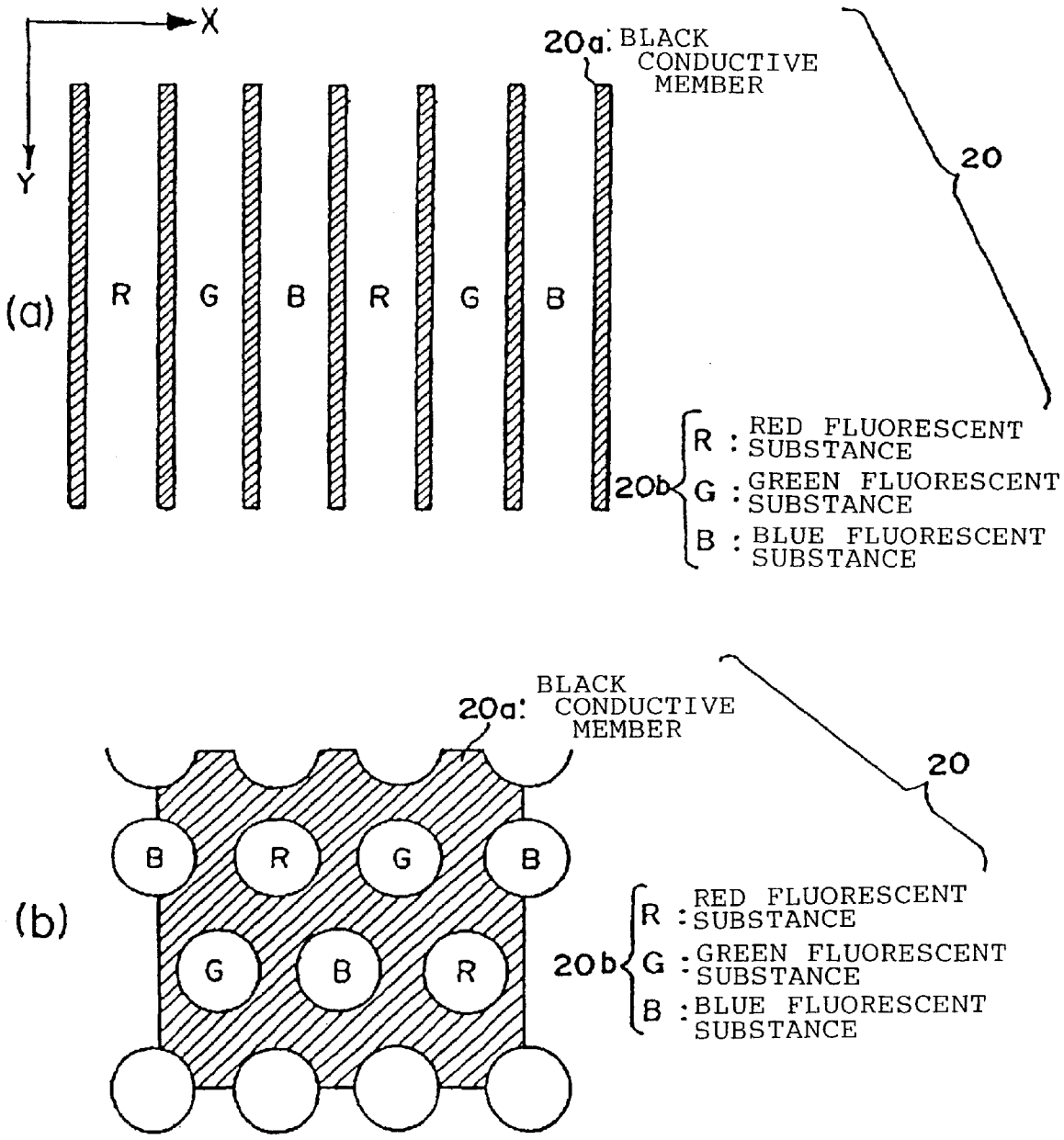
FIG. 6 shows plan views each exemplifying the layout of fluorescent substances on the face plate of the display panel.

A fluorescent film 20 is formed on the lower surface of the face plate 19. Since this embodiment is a color display apparatus, the fluorescent film 20 is coated with three, red, green, and blue primary color fluorescent substances which are irradiated with an electron beam and used in the CRT field. As shown in FIG. 6(*a*), fluorescent substances of the respective colors are applied in stripes, and black conductive members 20*a* are provided between the stripes of the fluorescent substances. The purpose of providing the black conductive members 20*a* is to prevent display color misregistration even if the irradiation position of an electron beam deviates to some extent, to prevent a decrease in display contrast by shutting off reflection of external light, and when the conductive member 20*a* is conductive, to prevent charge-up of the fluorescent film by an electron beam. As the material of the black conductive members 20*a*, graphite is used as a main component, but other materials may be used so long as the above purpose is attained.

Further, fluorescent substances of the three primary colors are not limited to stripes shown in FIG. 6(*a*). For example, fluorescent substances may be applied in a delta layout as shown in FIG. 6(*b*) or another layout.

In fabricating a monochrome display panel, a fluorescent substance material of a single color may be used for a fluorescent film 20*b*, and the black conductive member may be omitted.

A metal back 21, which is well-known in the CRT field, is formed on a surface of the fluorescent film 20 on the rear plate side. The purpose of providing the metal back 21 is to improve the light-utilization ratio by mirror-reflecting part of the light emitted by the fluorescent film 20, to protect the fluorescent film 20 from collision with negative ions, to use the metal back 21 as an electrode for applying an electron-beam acceleration voltage, and to use the metal back 21 as a conductive path for electrons which excited the fluorescent film 20. The metal back 21 is formed by forming the fluorescent film 20 on the face plate substrate 19, smoothing the front surface of the fluorescent film, and evaporating Al thereon in vacuum. If a low-voltage fluorescent substance material is used for the fluorescent film 20, the metal back 21 is not used.

To apply an acceleration voltage or improve the conductivity of the fluorescent film, transparent electrodes made of, e.g., ITO may be provided between the face plate substrate 19 and the fluorescent film 20, though such electrodes are not used in this embodiment.

As shown in FIG. 1, the spacer 22 is a member obtained by forming a conductive film 23 on the surface of the insulating member 24 of the spacer 22, and forming low-resistance films 25 on abutment surfaces of the spacer which face the inner surface (metal back 21 and the like) of the face plate 19 and the surface (row-direction wiring line 15 or column-direction wiring line 16) of the substrate 13. The number of spacers 20 necessary for achieving the above object are fixed on the inner surface of the face plate and the surface of the substrate 13 at necessary intervals with bonding members 26.

The conductive film 23 is formed at least a surface of the insulating base 24 exposed in vacuum in the airtight container. The conductive film 23 are electrically connected to the inner surface (metal back 21 and the like) of the face plate 19 and the surface (row-direction wiring line 15 or column-direction wiring line 16) of the substrate 13 via the low-resistance films 25 and bonding members 26 on the spacer 22. In this embodiment, the spacer 22 has a thin plate shape, is arranged in parallel with the row-direction wiring line 15, and is electrically connected to the row-direction wiring line 15.

The low-resistance films 25 which constitute the spacer 22 electrically connect the conductive film 23 formed from a high-resistance film 23*b* and semiconductive film 23*a* to the face plate 19 (metal back 21 and the like) on the high-potential side and the substrate 17 (wiring lines 15 and 16 and the like) on the low-potential side. The low-resistance films 25 will be called intermediate electrode layers (intermediate electrodes) hereinafter. The intermediate electrode layers (intermediate layers) have the following functions.

(1) The intermediate electrode layers 25 electrically connect the conductive film 23 to the face plate 19 and substrate 13.

As described above, the conductive film 23 is formed to prevent charge on the surface of the spacer 22. When the conductive film 23 is connected to the face plate 19 (metal back 21 and the like) and substrate 13 (wiring line 15 or 16 and the like) directly or through the bonding members 26, a large contact resistance is generated at the interfaces of the connected portions, failing to quickly remove charges generated on the surface of the spacer 22. To prevent this, the low-resistance intermediate electrodes 25 are formed on the abutment surfaces or side surface portions of the spacer 22 in contact with the face plate 19, substrate 13, and bonding members 26.

(2) The intermediate electrode layers 25 make the potential distribution of the conductive film 23 uniform.

Electrons emitted by the cold cathode electron-emitting elements 14 follow electron orbits in accordance with the potential distribution formed between the face plate 19 and the substrate 13. To prevent disturbance of the electron orbits near the spacer 22, the entire potential distribution of the conductive film 23 must be controlled. When the conductive film 23 is connected to the face plate 19 (metal back 21 and the like) and substrate 13 (wiring line 15 or 16 and the like) directly or through the bonding members 26, the connected state varies owing to the contact resistance at the interfaces of the connected portions, and the potential distribution of the conductive film 23 may deviate from a desired value. To prevent this, the low-resistance intermediate layers 25 are formed on the entire spacer end portions (abutment surfaces or side surface portions) of the spacer 22 in contact with the face plate 19 and substrate 13. By applying a desired potential to the intermediate layer portions 25, the potential of the entire conductive film 23 can be controlled.

(3) The intermediate electrode layers 25 control the orbits of emitted electrons.

Electrons emitted by the cold cathode electron-emitting elements 14 follow electron orbits in accordance with the potential distribution formed between the face plate 19 and the substrate 13. Electrons emitted by cold cathode electron-emitting elements near the spacer 22 may be constrained (changed in wiring lines and element positions) owing to the presence of the spacer 22. In this case, to form an image free from any distortion and fluctuation, the orbits of emitted electrons must be controlled to irradiate desired positions on the face plate 19 with electrons. By forming the low-resistance intermediate layers 25 on the side surface portions in contact with the face plate 19 and substrate 13, the potential distribution near the spacer 22 can be given desired characteristics to control the orbits of emitted electrons.

The low-resistance film 25 serving as an intermediate electrode suffices to be formed from a material having a much smaller resistance value than that of the high-resistance film 23*a*. Examples of this material are metals such as Ni, Cr, Au, Mo, W, Pt, Ti, Al, Cu, and Pd, alloys thereof, printed conductors made of metals such as Pd, Ag, Au, $RuO_2$, and Pd—Ag or metal oxides and glass, or transparent conductors such as $In_2O_3$—$SnO_2$, and semiconductor materials such as polysilicon. The structure of the low-resistance film 25 is preferably a continuous film in order to realize a small resistance value.

The bonding members 26 must be conductive so as to electrically connect the spacer 22 to the row-direction wiring line 15 and metal back 21. Examples of the bonding members 26 are a conductive adhesive, and frit glass containing metal particles or conductive filler.

External joint terminals Dx1 to Dxm and Dy1 to Dyn, and a high-voltage terminal Hv are electric connection terminals for an airtight structure provided to electrically connect the display panel to an electric circuit (not shown). Dx1 to Dxm are electrically connected to the row-direction wiring lines 15 of the multi electron beam source; Dy1 to Dyn, to the column-direction wiring lines 16 of the multi electron beam source; and Hv, to the metal back 21 of the face plate.

To evacuate the interior of the airtight container, the airtight container is assembled, and then an exhaust pipe and vacuum pump (neither is shown) are connected to evacuate the interior of the airtight container to a vacuum degree of about $10^{-5}$ Pa. Thereafter, the exhaust pipe is sealed. To maintain the vacuum degree in the airtight container, a getter film (not shown) is formed at a predetermined position in the airtight container immediately before/after sealing. The getter film is a film formed by heating and evaporating a getter material mainly consisting of, e.g., Ba, by a heater or RF heating. The adsorption effect of the getter film maintains a vacuum degree of $1\times10^{-3}$ or $1\times10^{-5}$ Pa in the airtight container.

In an image display apparatus using the above-described display panel, a voltage is applied to the cold cathode electron-emitting elements 14 via the outer container terminals Dx1 to Dxm and Dy1 to Dyn to emit electrons from the cold cathode electron-emitting elements 14. At the same time, a high voltage of several kV is applied to the metal back 21 via the outer container terminal Hv, and the emitted electrons are accelerated and collide with the inner surface of the face plate 19. Then, fluorescent substances of the respective colors that form the fluorescent film 20 are excited to emit light, thereby displaying an image.

In general, the application voltage to the surface-conduction type electron-emitting elements 14 of this embodiment serving as cold cathode electron-emitting elements is about 12 to 16 [V], a distance d between the metal back 21 and the cold cathode electron-emitting element 14 is about 1 mm to 8 mm, and the voltage between the metal back 21 and the cold cathode electron-emitting element 14 is about 3 kV to 15 kV.

The basic arrangement and manufacturing method of the display panel and the outline of the image display apparatus according to the embodiment of the present invention have been described.

[Arrangement and Manufacturing Method of Multi Electron Beam Source]

A method of manufacturing the multi electron beam source used in the display panel of this embodiment will be described. In the multi electron beam source used in the image display apparatus according to the image display apparatus of the present invention, the material, shape, and manufacturing method of the cold cathode electron-emitting element are not particularly limited as far as an electron source is constituted by wiring cold cathode electron-emitting elements in a simple matrix. For example, the image display apparatus can use cold cathode electron-emitting elements such as surface-conduction type electron-emitting elements, FE type elements, or MIM type elements.

Under circumstances where low-cost display apparatuses having large display screens are required, the surface-conduction type electron-emitting element is especially preferable among these cold cathode electron-emitting elements. More specifically, the FE type element requires a high-precision manufacturing technique because its electron emission characteristics are greatly influenced by the relative positions and shapes of the emitter cone and gate electrode. This is disadvantageous in attaining a large display area and a low manufacturing cost. In the MIM type element, the insulating layer and upper electrode must be made thin and uniform. This is also disadvantageous in attaining a large display area and a low manufacturing cost. In contrast to this, the surface-conduction type electron-emitting element can be manufactured by a relatively simple method, and can achieve a large display area and a low manufacturing cost. The present inventors have also found that among the surface-conduction type electron-emitting elements, an element having an electron-emitting portion or its peripheral portion made of a fine particle film exhibits excellent electron emission characteristics and can be easily manufactured.

Such element is most suitable for the multi electron beam source of a high-luminance, large-screen image display apparatus. For this reason, the display panel of this embodiment uses surface-conduction type electron-emitting elements each having an electron-emitting portion or its peripheral portion made of a fine particle film. The basic structure, manufacturing method, and characteristics of the preferred surface-conduction type electron-emitting element will be described first. The structure of the multi electron beam source having many elements wired in a simple matrix will be described later.

(Preferred Structure and Manufacturing Method of Surface-conduction Type Electron-emitting Element)

Typical arrangements of surface-conduction type electron-emitting elements each having an electron-emitting portion or its peripheral portion made of a fine particle film include two types of elements, namely flat and step type elements.

(Flat Surface-conduction Type Electron-emitting Element)

The element structure and manufacturing method of a flat surface-conduction type electron-emitting element will be described. FIGS. 5(*a*) and 5(*b*) are a plan view and a sectional view, respectively, for explaining the structure of the flat surface-conduction. type electron-emitting element. Referring to FIGS. 5(*a*) and 5(*b*), reference numeral 13 denotes a substrate; 27 and 28, element electrodes; 29, a conductive thin film; 30, an electron-emitting portion formed by electrification forming processing; and 31, a thin film formed by electrification activation processing.

As the substrate 13, various glass substrates of quartz glass, soda-lime glass, and the like, various ceramic substrates of alumina and the like, or substrates prepared by stacking an insulating layer of, e.g., $SiO_2$ on these substrates can be employed.

The element electrode 27 and element electrode 28 arranged on the substrate 13 to face each other in parallel with the substrate surface are made of a conductive material. Examples of the material are metals such as Ni, Cr, Au, Mo, W, Pt, Ti, Cu, Pd, and Ag, alloys of these metals, metal oxides such as $In_2O_3$—$SnO_2$, and semiconductors such as polysilicon. The electrodes can be easily formed by a combination of a film formation technique such as vacuum evaporation and a patterning technique such as photolithography or etching. Another method (e.g., printing technique) may be employed.

The shape of the element electrodes 27 and 28 is appropriately designed in accordance with an application purpose of the electron-emitting element. Generally, an interval L between the electrodes is designed by selecting an appropriate value from the range of several hundred Å to several hundred $\mu$m. The most preferable range for a display apparatus is from several $\mu$m to several ten $\mu$m. As for a thickness d of the element electrodes 27 and 28, an appropriate value is selected from the range of several hundred Å to several $\mu$m.

The conductive thin film 29 is formed from a fine particle film. The fine particle film is a film that contains a lot of fine particles (including island-like masses of particles) as constituent elements. The fine particle film is microscopically examined to observe a structure in which individual fine particles exist at intervals, exist adjacent to each other, or overlap each other.

The particle of the fine particle film has a diameter falling within the range of several Å to several thousand Å, and preferably the range of 10 Å to 200 Å. The film thickness of the fine particle film is appropriately set in consideration of the following conditions. That is, conditions necessary for electrically connecting the element electrode 27 or 28, conditions necessary for performing electrification forming (to be described later), and conditions necessary for setting the electrical resistance of the fine particle film to an appropriate value (to be described later). For example, the film thickness is set within the range of several Å to several thousand Å, and preferably the range of 10 Å to 500 Å.

Examples of the material used for forming the fine particle film of the conductive thin film 29 are metals such as Pd, Pt, Ru, Ag, Au, Ti, In, Cu, Cr, Fe, Zn, Sn, Ta, W, and Pb, oxides such as PdO, $SnO_2$, $In_2O_3$, PbO, and $Sb_2O_3$, borides such as $HfB_2$, $ZrB_2$, $LaB_6$, $CeB_6$, $YB_4$, and $GdB_4$, carbides such as TiC, ZrC, HfC, TaC, SiC, and WC, nitrides such as TiN, ZrN, and HfN, semiconductors such as Si and Ge, and carbons. The material is appropriately selected from them.

As described above, the conductive thin film 29 is formed from a fine particle film, and its sheet resistance is set to fall within the range of $10^3$ to $10^7$ (Ω/□).

Figure 7:
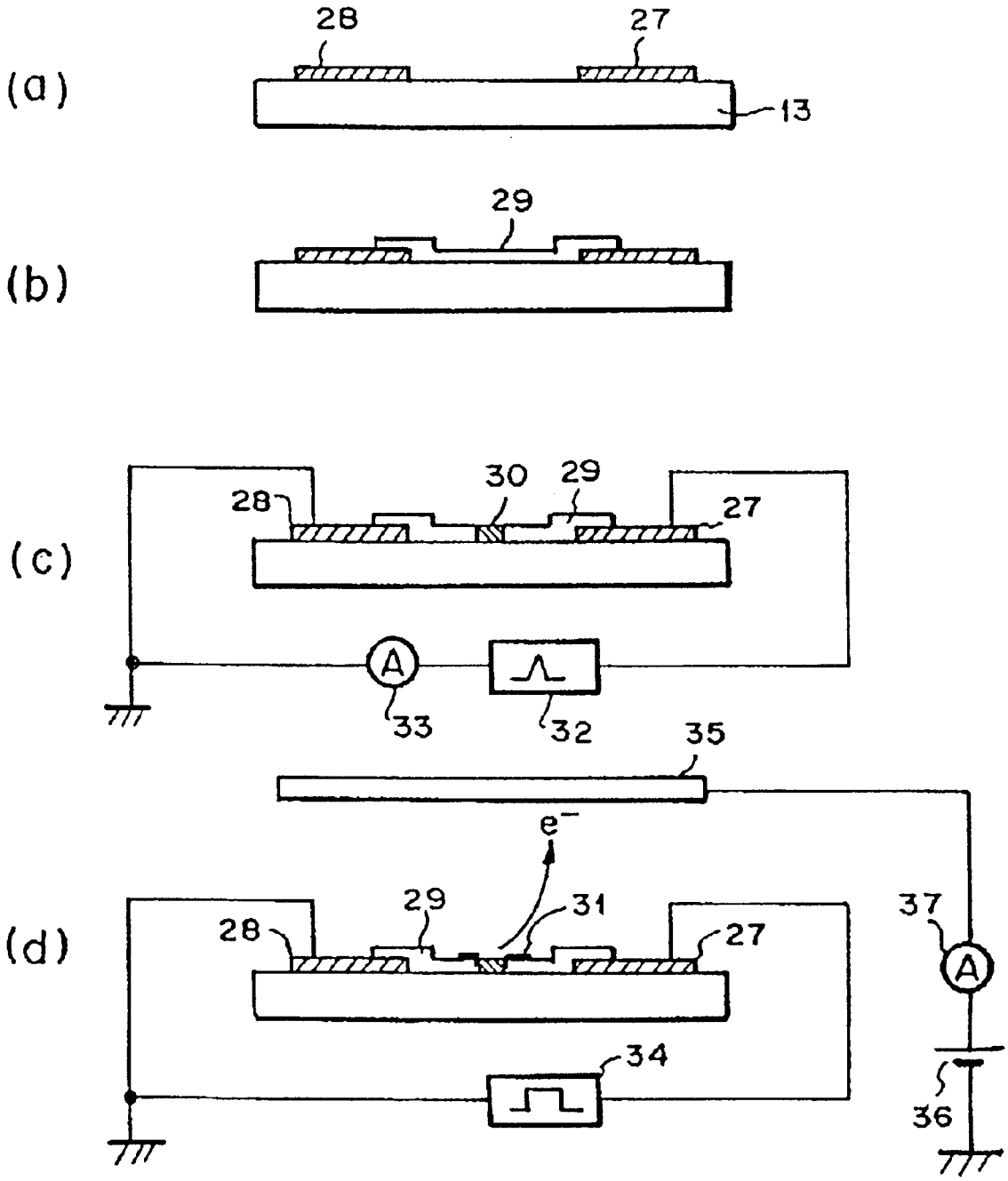
FIG. 7 shows sectional views, respectively, showing the steps in manufacturing the flat surface-conduction type electron-emitting element.

The conductive thin film 29 and the element electrodes 27 and 28 partially overlap each other so as to electrically connect them to each other with high reliability. In FIG. 7, the substrate 13, element electrodes 27 and 28, and conductive thin film 29 are stacked in this order from the bottom. Alternatively, the substrate 13, conductive thin film 29, and element electrodes 27 and 28 may be stacked in this order from the bottom.

The electron-emitting portion 30 is a fissured portion formed at part of the conductive thin film 29, and has an electrically higher resistance than that of the peripheral conductive thin film. The fissure is formed by forming electrification forming processing for the conductive thin film 29. In some cases, particles having a diameter of several Ω to several hundred Ω are deposited in the fissure. As it is difficult to exactly illustrate the actual position and shape of the electron-emitting portion, FIG. 7 schematically shows the electron-emitting portion.

The thin film 31, which is made of carbon or a carbon compound, covers the electron-emitting portion 30 and its peripheral portion. The thin film 31 is formed by electrification activation processing (to be described later) after electrification forming processing.

The thin film 31 is graphite monocrystalline, graphite polycrystalline, amorphous carbon, or mixture thereof, and its film thickness is 500 [Å] or less, and preferably 300 [Å] or less.

The basic structure of the preferred element has been described. This embodiment uses the following element.

That is, the substrate 13 was made of soda-lime glass, and the element electrodes 27 and 28 were formed from an Ni thin film. The thickness d of the element electrode was 1,000 [Å], and the electrode interval L was 2 [μm].

The main material of the fine particle film was Pd or PdO. The fine particle film had a thickness of about 100 [Å] and a width W of 100 [μm].

(Manufacturing Method of Flat Surface-conduction Type Electron-emitting Element)

Next, a method of manufacturing a preferred flat surface-conduction type electron-emitting element will be described.

FIGS. 7(*a*) to 7(*d*) are sectional views for explaining the steps in manufacturing the surface-conduction type electron-emitting element. The same reference numerals as in FIG. 5 denote the same parts.

(1) As shown in FIG. 7(*a*), the element electrodes 27 and 28 are formed on the substrate 13.

In formation, the substrate 13 is fully washed with a detergent, pure water, and an organic solvent, and the material of the element electrode is deposited. As the deposition method, a vacuum film formation technique such as an evaporation method or sputtering method may be used. The deposited electrode material is patterned by photolithography etching into a pair of element electrodes (27 and 28) shown in FIG. 7(*a*).

(2) As shown in FIG. 7(*b*), the conductive thin film 29 is formed.

In formation, an organic metal solvent is applied to the substrate in FIG. 7(*a*), dried, heated, and baked to form a fine particle film. The fine particle film is patterned into a predetermined shape by photolithography etching. The organic metal solvent is an organic metal compound solvent mainly containing the fine particle material used for the conductive thin film 29. More specifically, this embodiment used Pd as a main element. Further, this embodiment used dipping as a coating method, but may use another method such as a spinner method or spraying method.

The film formation method of the conductive thin film 29 formed from the fine particle film is not limited to application of the organic metal solvent used in the embodiment, but may be another method such as a vacuum evaporation method, sputtering method, or chemical vapor deposition method.

(3) As shown in FIG. 7(*c*), a proper voltage is applied between the element electrodes 27 and 28 from a forming power source 32 to perform electrification forming processing, thereby forming the electron-emitting portion 30.

Electrification forming processing is processing of performing electrification for the conductive thin film 29 made of the fine particle film to destroy, deform, or deteriorate part of the conductive thin film 29, and changing it into a structure suitable for electron emission. In the conductive thin film made of the fine particle film, an appropriate fissure is formed in the thin film at a portion changed into a structure suitable for electron emission (i.e., electron-emitting portion 30). After the electron-emitting portion 30 is formed, the electrical resistance measured between the element electrodes 27 and 28 greatly increases, compared to the electrical resistance before the electron-emitting portion 30 is formed.

Figure 8:
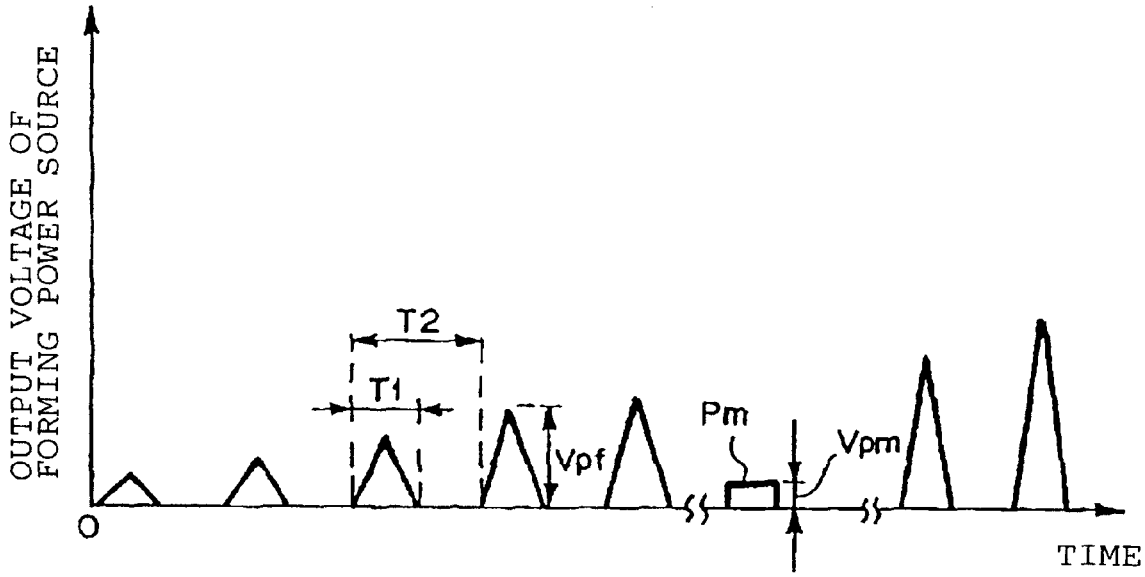
FIG. 8 is a waveform chart of an application voltage in electrification forming processing.

FIG. 8 shows an example of an appropriate voltage waveform applied from the forming power source 32 in order to explain the electrification method in more detail. When forming is done for the conductive thin film 29 made of the fine particle film, a pulse-like voltage is preferable. In this embodiment, as shown in FIG. 8, a triangular-wave pulse having a pulse width T1 was continuously applied at a pulse interval T2. At this time, a peak value Vpf of the triangular-wave pulse was sequentially increased. Further, a monitor pulse Pm for monitoring the formation status of the electron-emitting portion 30 was inserted between triangular-wave pulses at a proper interval, and a flowing current was measured by a galvanometer 33.

In this embodiment, the pulse width T1 was set to 1 [msec], the pulse interval T2 was set to 10 [msec], and the peak value Vpf was increased by 0.1 [V] every pulse in a vacuum atmosphere of about $1.3\times10^{-1}$ Pa. The monitor pulse Pm was inserted every five triangular-wave pulses. To avoid any adverse influence on forming processing, a voltage Vpm of the monitor pulse was set to 0.1 [V]. When the electrical resistance between the element electrodes 27 and 28 reached $1\times10^6$ Ω, i.e., a current measured by the galvanometer 33 upon application of monitor pulses reached $1\times10^{-7}$ A or less, electrification for forming processing ended.

Note that this method is preferable for the surface-conduction type electron-emitting element of the embodiment. In case of changing the design of the surface-conduction type electron-emitting element concerning such as the material or film thickness of the fine particle film or the interval L between the element electrodes, electrification conditions are desirably changed in accordance with the changed design.

(4) As shown in FIG. 7(*d*), a proper voltage is applied between the element electrodes 27 and 28 from an activation power source 34 to perform electrification activation processing so as to improve electron emission characteristics.

Electrification activation processing is processing of performing electrification for the electron-emitting portion 30 formed by forming electrification forming processing under appropriate conditions, and depositing carbon or a carbon compound around the electron-emitting portion 30. In FIG. 7(*d*), a deposit of carbon or a carbon compound is illustrated as a material 31. After electrification activation processing is done, the emission current at the same application voltage can be increased to be typically 100 times or more than the emission current before electrification activation processing is done.

More specifically, a voltage pulse is periodically applied in a vacuum atmosphere of $10^{-1}$ to $10^{-4}$ Pa, thereby depositing carbon or a carbon compound mainly derived from an organic compound present in a vacuum atmosphere. The deposit 31 is graphite monocrystalline, graphite polycrystalline, amorphous carbon, or mixture thereof. The film thickness of the accumulated material 31 is 500 [Å] or less, and more preferably 300 [Å] or less.

Figure 9:
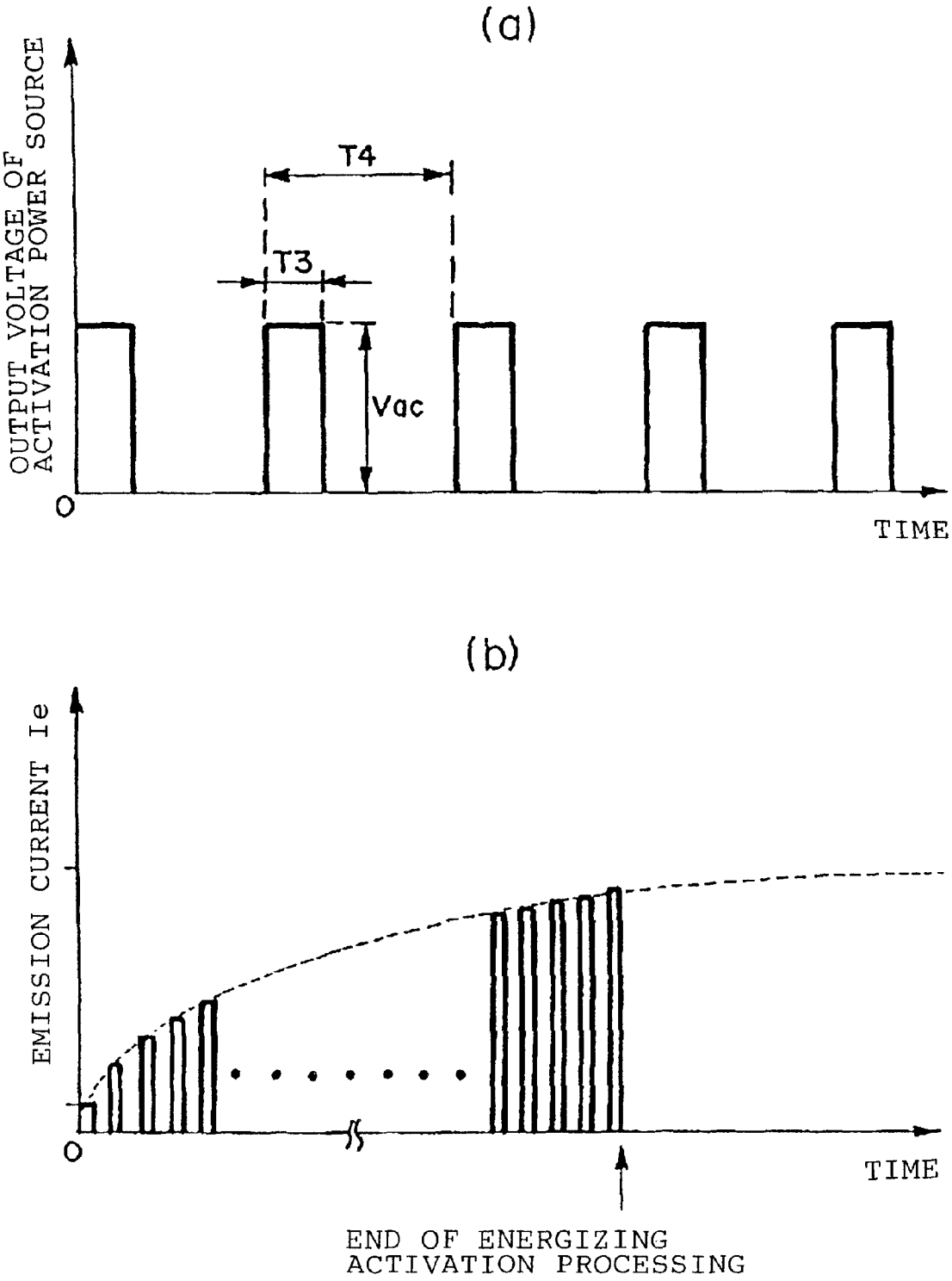
FIG. 9 shows views of the application voltage waveform (a) and a change (b) in emission current Ie in energizing activation processing.

FIG. 9(*a*) shows an example of an appropriate voltage waveform applied from the activation power source 34 in order to explain the electrification method in more detail. In this embodiment, electrification activation processing was done by periodically applying a rectangular wave of a predetermined voltage. A voltage Vac of the rectangular wave was set to 14 [V]; a pulse width T3, to 1 [msec]; and a pulse interval T4, 10 [msec]. These electrification conditions are preferable conditions for the surface-conduction type electron-emitting element of this embodiment. In case of changing the design of the surface-conduction type electron-emitting element, the electrification conditions are preferably changed in accordance with the changed design.

In FIG. 7(*d*), reference numeral 35 denotes an anode electrode for capturing an emission current Ie emitted from the surface-conduction type electron-emitting element. The anode electrode 35 is connected to a DC high-voltage power source 36 and galvanometer 37. In case of performing activation processing after the substrate 13 is assembled in the display panel, the fluorescent screen of the display panel is used as the anode electrode 35. While applying a voltage from the activation power source 34, the galvanometer 37 measures the emission current Ie, and monitors the progress of electrification activation processing to control the operation of the activation power source 34. FIG. 9(*b*) shows an example of the emission current Ie measured by the galvanometer 37. As the activation power source 34 starts applying a pulse voltage, the emission current Ie increases with the lapse of time, gradually comes into saturation, and hardly increases. When the emission current Ie substantially saturates, the activation power source 34 stops applying the voltage, and energizing activation processing ends.

Note that these electrification conditions are preferable conditions for the surface-conduction type electron-emitting element of this embodiment. In case of changing the design of the surface-conduction type electron-emitting element, the conditions are preferably changed in accordance with the changed design.

In this manner, the flat surface-conduction type electron-emitting element as shown in FIG. 5(*b*) was manufactured.

(Stepped Surface-conduction Type Electron-emitting Element)

Next, another typical structure of the surface-conduction type electron-emitting element having an electron-emitting portion or its peripheral portion formed from a fine particle film, i.e., a stepped surface-conduction type electron-emitting element will be described.

Figure 10:
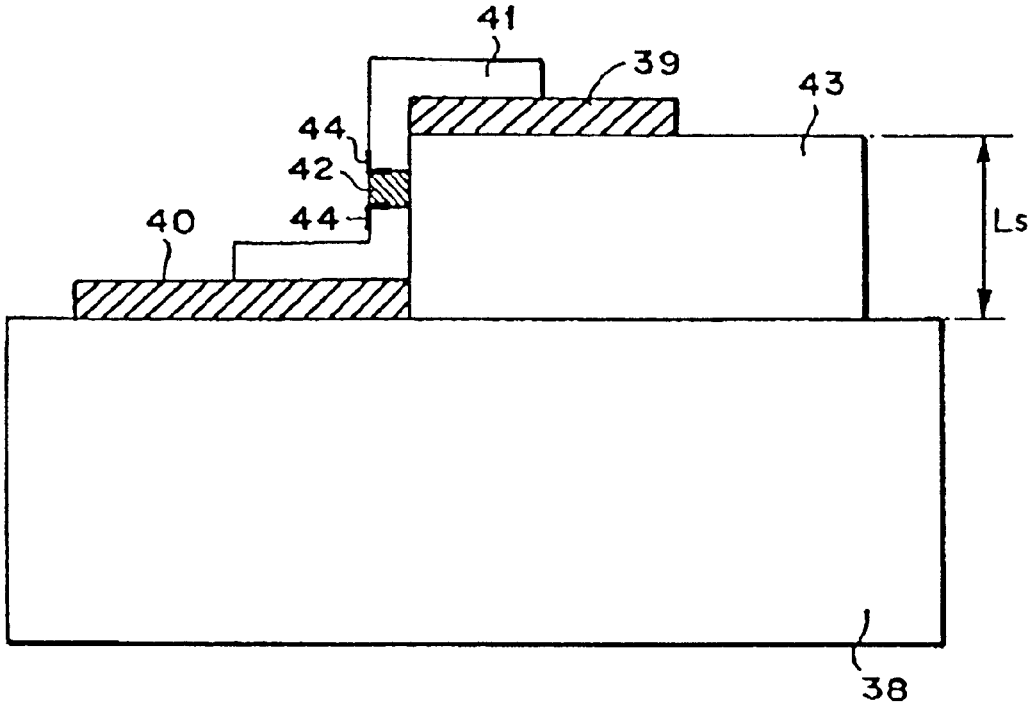
FIG. 10 is a sectional view of a stepped surface-conduction type electron-emitting element used in the embodiment.

FIG. 10 is a schematic sectional view for explaining the basic structure of the stepped surface-conduction type electron-emitting element. In FIG. 10, reference numeral 38 denotes a substrate; 39 and 40, element electrodes; 43, an insulating step-forming member; 41, a conductive thin film using a fine particle film; 42, an electron-emitting portion formed by electrification forming processing; and 44, a thin film formed by electrification activation processing.

The stepped surface-conduction type electron-emitting element is different from the above-described flat element in that one element electrode 39 is formed on the step-forming member 43 and the conductive thin film 41 covers the side surface of the step-forming member 43. The element interval L in FIG. 5(*a*) is set as a step height Ls of the step-forming member 43 in the stepped element. The substrate 38, element electrodes 39 and 40, and conductive thin film 41 using the fine particle film can use the materials listed in the description of the flat surface-conduction type electron-emitting element. The step-forming member 43 uses an electrically insulating material such as $SiO_2$.

(Manufacturing Method of Stepped Surface-conduction Type Electron-emitting Element)

Figure 11:
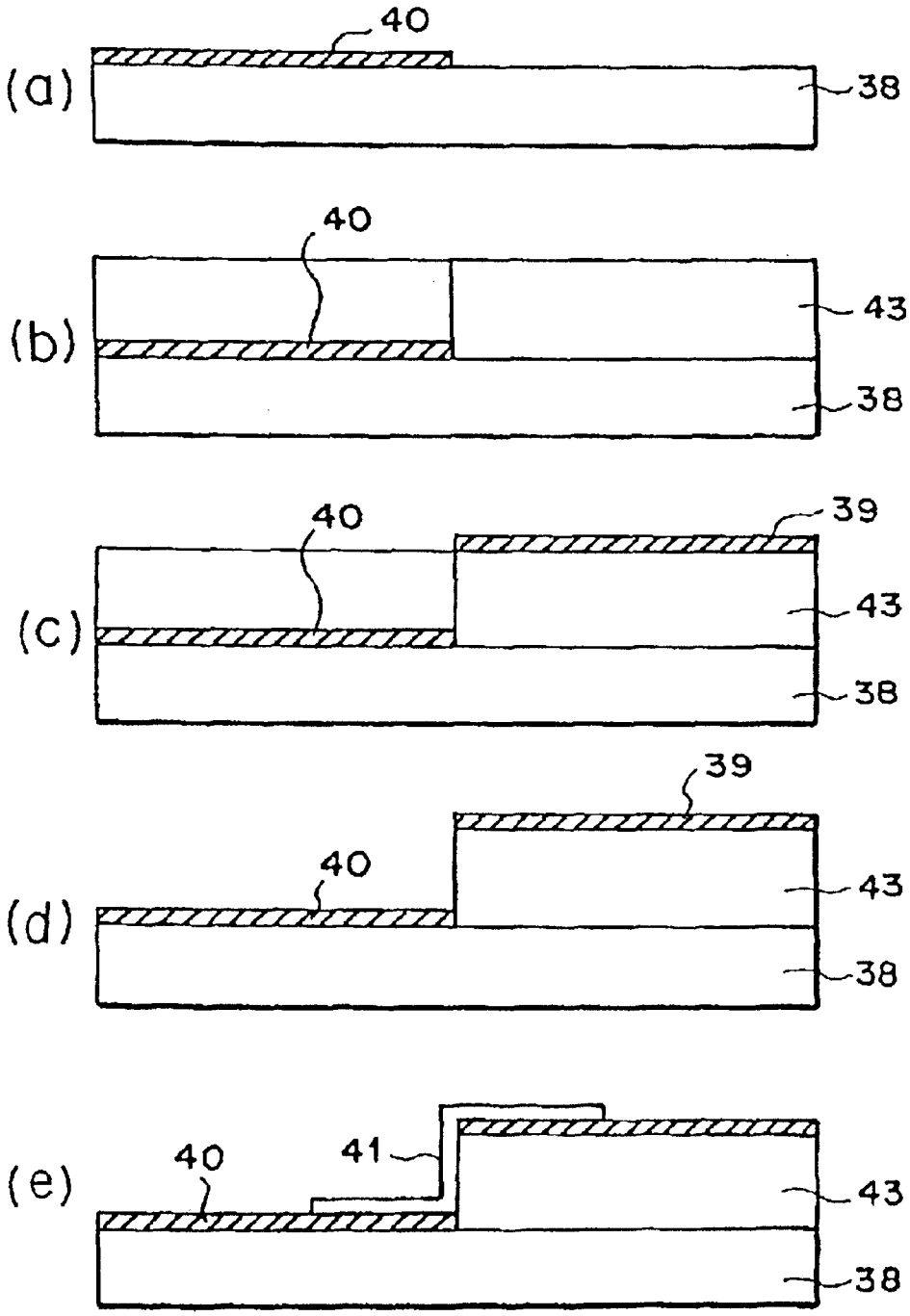
FIG. 11 shows sectional views, respectively, showing the steps in manufacturing the stepped surface-conduction type electron-emitting element.

A method of manufacturing the stepped surface-conduction type electron-emitting element will be described. FIGS. 11(*a*) to 11(*e*) are sectional views for explaining the manufacturing steps. The same reference numerals as in FIG. 10 denote the same parts.

(1) As shown in FIG. 11(*a*), the element electrode 40 is formed on the substrate 38.

(2) As shown in FIG. 11(*b*), an insulating layer for forming the step-forming member 43 is formed. The insulating layer may be formed by sputtering, e.g., $SiO_2$, but may be formed by another film formation method such as a vacuum evaporation method or printing method.

(3) As shown in FIG. 11(*c*), the element electrode 39 is formed on the insulating layer.

(4) As shown in FIG. 11(*d*), part of the insulating layer is removed by, e.g., an etching method to expose the element electrode 40.

(5) As shown in FIG. 11(*e*), the conductive thin film 41 using the fine particle film is formed. To form the film 41, a film formation technique such as a coating method is used similar to the flat element.

(6) Similar to the flat element, electrification forming processing is performed to form an electron-emitting portion 42. Note that the same processing as electrification forming processing for the flat element described with reference to FIG. 7(*c*) is performed.

(7) Similar to the flat element, electrification activation processing is performed to deposit carbon or a carbon compound around the electron-emitting portion 42. In this case, the same processing as electrification activation processing for the flat element structure described with reference to FIG. 7(*d*) is performed.

In this fashion, the stepped surface-conduction type electron-emitting element shown in FIG. 10 was manufactured.

(Characteristics of Surface-conduction Type Electron-emitting Element Used in Display Apparatus)

The element structures and manufacturing methods of the flat and stepped surface-conduction type electron-emitting elements have been described above. Next, the characteristics of the element used in the display apparatus will be described.

Figure 12:
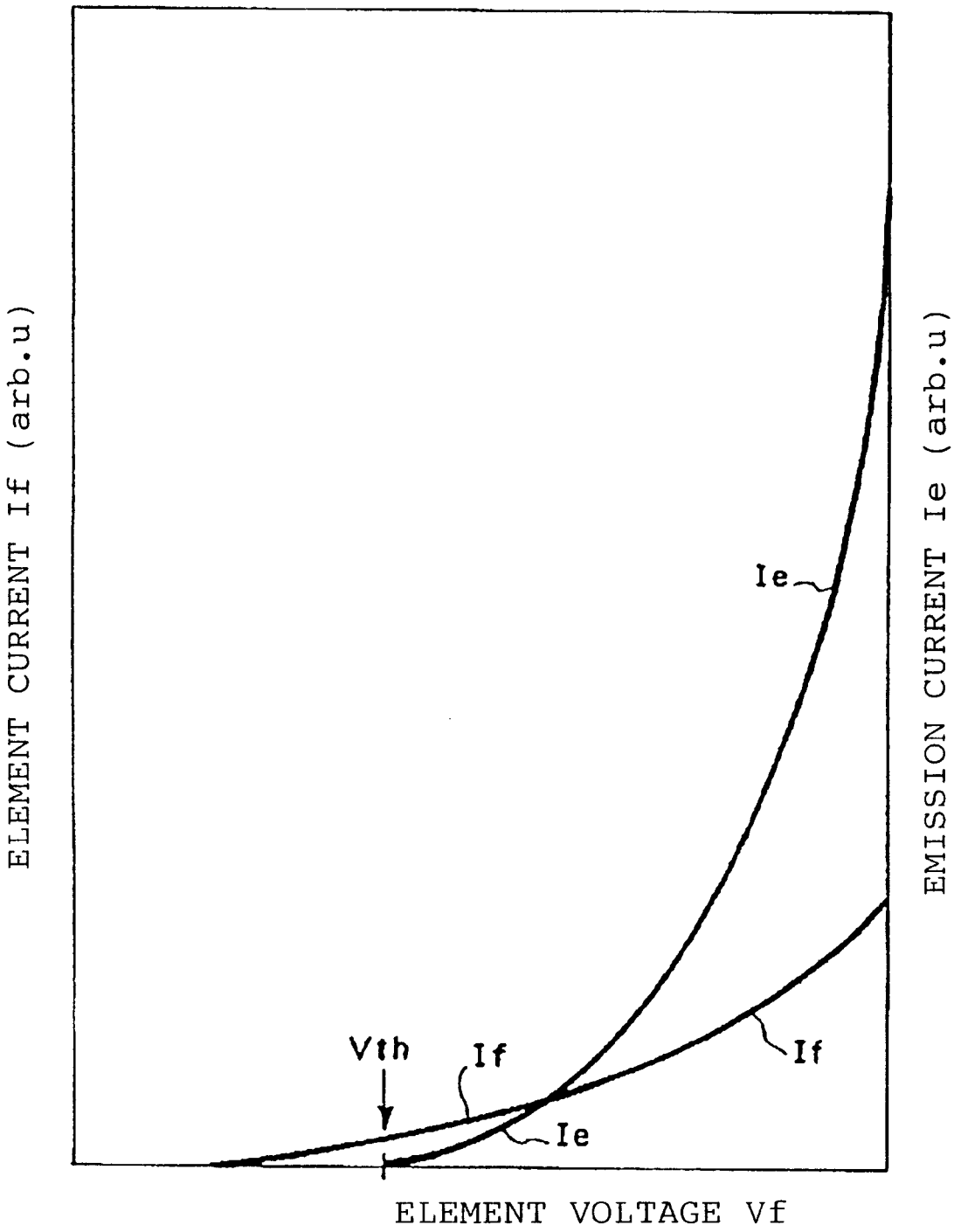
FIG. 12 is a graph showing a typical characteristic of the surface-conduction type electron-emitting element used in the embodiment.
Figure 13:
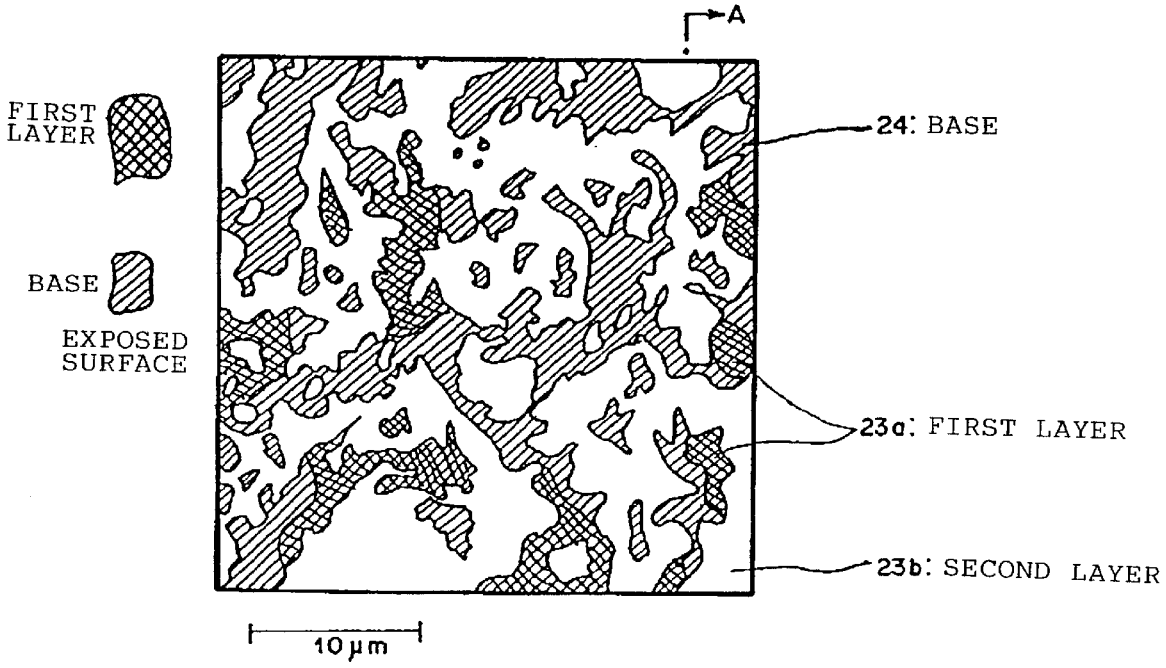
FIG. 13 is an enlarged view of a first layer or second layer with a structure in a mixed state of a network structure and island shape used in the embodiment of the present invention.

FIG. 12 shows typical examples of the (emission current Ie) vs. (element electrode application voltage Vf) characteristic and the (element current If) vs. (element electrode application voltage Vf) characteristic of the element used in the display apparatus. The emission current Ie is much smaller than the element current If, and it is difficult to illustrate the emission current Ie by the same measure as the element current If. In addition, these characteristics change when design parameters such as the size and shape of the element are changed. Thus, the two characteristics of the graph are illustrated in arbitrary units.

Regarding the emission current Ie, the element used in the display apparatus has the following three characteristics:

First, when a voltage of a predetermined level (to be referred to as a threshold voltage Vth) or more is applied to the element, the emission current Ie abruptly increases. To the contrary, almost no emission current Ie is detected at a voltage lower than the threshold voltage Vth. That is, the element is a nonlinear element having the clear threshold voltage Vth for the emission current Ie.

Second, the emission current Ie changes depending on the voltage Vf applied to the element. Hence, the magnitude of the emission current Ie can be controlled by the voltage Vf.

Third, the response speed of the current Ie ($\mu$A) emitted by the element for the voltage Vf (V) applied to the element is high. Thus, a charge amount of electrons emitted by the element can be controlled by the application time of the voltage Vf.

The surface-conduction type electron-emitting element having these characteristics could be preferably applied to the display apparatus. For example, if the first characteristic is used in a display apparatus having many elements in correspondence with the pixels of the display screen, the display screen can be sequentially scanned to display an image. In other words, a voltage equal to or higher than the threshold voltage Vth is properly applied to an element during driving in accordance with a desired emission luminance, while a voltage lower than the threshold voltage Vth is applied to an unselected element. By sequentially changing elements to be driven, the display screen can be sequentially scanned to display an image.

By using the second or third characteristic, the emission luminance can be controlled to realize a gray-level display.

EXAMPLE

Detailed examples of the present invention will be explained with reference to the accompanying drawings.

Example 1

In this example, as shown in FIG. 1, a plurality of surface-conduction type electron sources 14 before forming were formed on a substrate 13. Soda-lime glass whose surface was cleaned was used as the substrate 13, and 160×720 surface-conduction type electron-emitting elements shown in FIG. 5 were formed in a matrix on the substrate 13.

Element electrodes 24 and 25 were Pt sputtering films, and an X-direction wiring line 15 and Y-direction wiring line 16 were Ag wiring lines formed by a screen printing method. A conductive thin film 26 was a fine PdO particle film formed by baking a Pd amine complex solution.

As shown in FIG. 6(*a*), a fluorescent film 20 serving as an image forming member employed a stripe shape extending in the Y direction for fluorescent substances of the respective colors, and used a shape in which black members 20*a* were provided not only between fluorescent substances of the respective colors but also in the X direction so as to separate pixels in the Y direction and ensure portions where spacers 22 were to be arranged. The black members (conductive members) 20*a* were first formed, and then fluorescent substances of the respective colors were applied to gaps between the black members 20*a*, thereby forming the fluorescent film 20. The material of the black stripes (black members 20*a*) was a material mainly containing graphite that is generally used. A method of applying fluorescent substances to a face plate 19 was a slurry method.

A metal back 21 formed on an inner surface side (electron source side) from the fluorescent film 20 was formed by performing smoothing processing (generally called filming) for a surface of the fluorescent film 20 on the inner surface side after the fluorescent film 20 was formed, and evaporating Al in vacuum. In some cases, a transparent electrode may be formed on an outer surface side of the face plate 19 from the fluorescent film 20 in order to increase the conductivity of the fluorescent film 20. This example omitted such a transparent electrode because a satisfactory conductivity was obtained only by the metal back.

In FIG. 2, the spacer 22 was prepared by forming an $In_2O_3$ film 23*a* by dipping on an insulating base 24 (height: 3.8 mm, thickness: 200 $\mu$m, length: 20 mm) made of cleaned soda-lime glass. After the substrate was dipped in a 5-time dilute solution of SYM-IN02 available from Kojundo Chemical Laboratory Co., Ltd., the substrate was pulled up at 20 mm/min, dried by an oven at 120° C. for 3 min, and baked at 450° C. for 2 h.

After each of these samples was formed as a first layer 23*a*, yttrium oxide of a second layer 23*b* was formed by dipping, thereby obtaining sample A. After the substrate was dipped in a 2-time dilute solution of SYM-Y01 available from Kojundo Chemical Laboratory Co., Ltd., the substrate was pulled up at 20 mm/min, dried by an oven at 120° C. for 3 min, and baked at 450° C. for 2 h. The materials, film thicknesses, resistance values, film formation conditions, and sample names of the first layer and second layer are as follows. Note that the shapes of the films were observed with an SEM.

(Sample A)

First Layer: $In_2O_3$, 10 nm, $5.5\times10^3$ Ωcm

Film Formation Condition of First Layer . . .

Raw Material: SYM-IN02 available from Kojundo Chemical Laboratory Co., Ltd. was diluted 5 times with xylene.

Pull-Up Speed: 20 mm/min

Baking Condition: 450° C., 2 h

Figure 16:
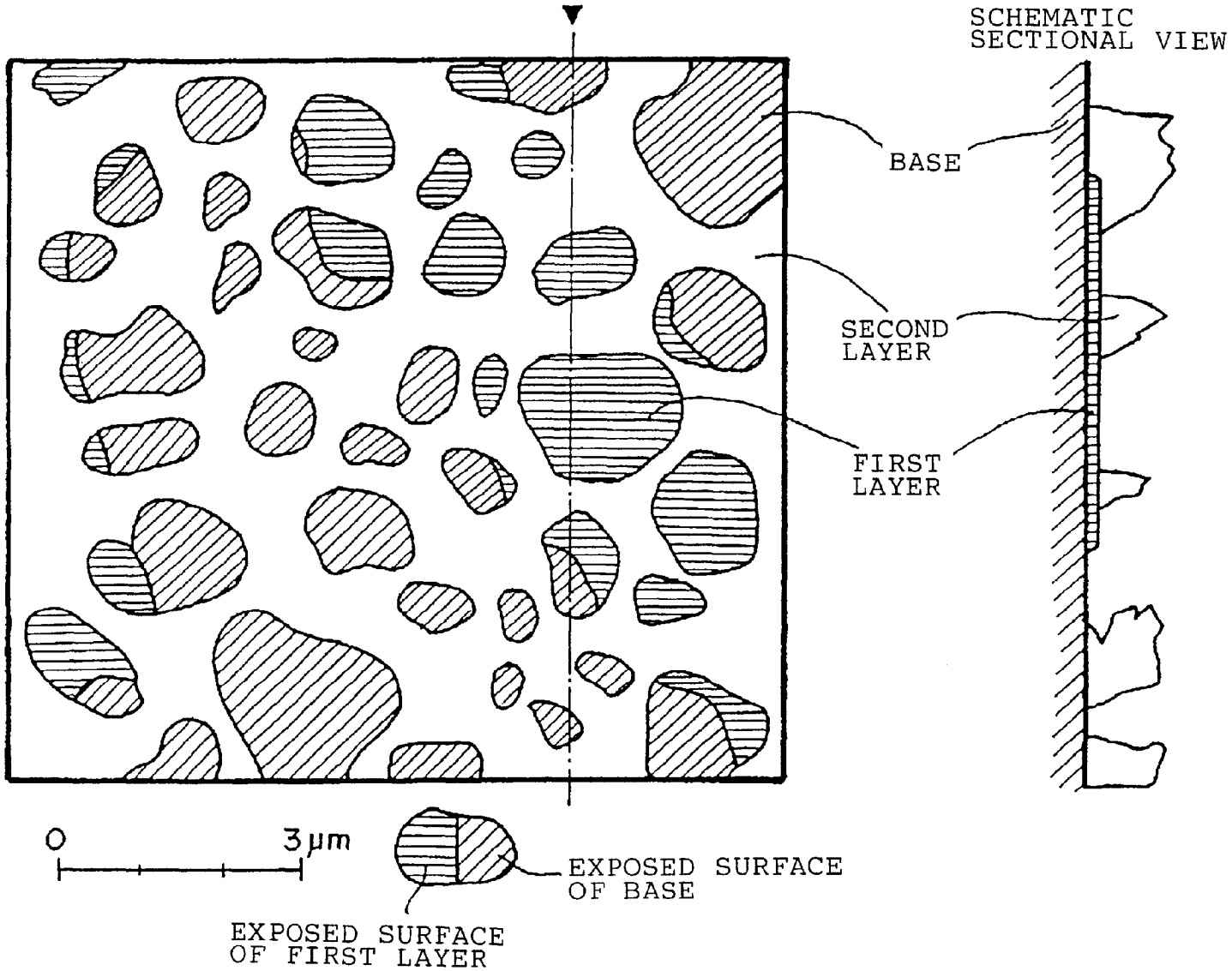
FIG. 16 shows a plan view and sectional view of a spacer used in the embodiment of the present invention.

Film Shape of First Layer . . . Network Structure (FIG. 16)

Second Layer: $Y_2O_3$, 400 nm (SYM-Y01 was diluted 2 times.)

Film Shape of Second Layer . . . Network Structure, Area of One Exposed Surface: 4 $\mu m^2$ on average Al electrodes 25 were formed at the connection portions of each spacer 22 in order to ensure electrical connection with the X-direction wiring line and metal back. The electrodes 25 completely covered the four surfaces of the spacer 22 within the range of 150 $\mu$m from the X-direction wiring line 15 to the face plate and the range of 100 $\mu$m from the metal back to the rear plate.

After that, the face plate 19 was arranged 3.8 mm above the electron source 14 via a support frame 18 serving as a side wall. Joint portions between the rear plate 17, face plate 19, support frame 18, and spacers 22 were fixed. The spacers were fixed on the row-direction wiring lines 15 at an equal interval. On the face plate 19 side, the spacers 22 used conductive frit glass 26 containing silica balls covered with Au on the black members 20*a* (line width: 300 $\mu$m), and rendered antistatic films 23 and the face plate 19 conductive. Note that part of the metal back 21 was removed in a region where the metal back 21 was in contact with the spacers 22.

Frit glass (not shown) was applied to a joint portion between the rear plate 17 and the support frame 18, and baked in the outer air at 420° C. for 10 min or more to seal the container.

Upon completion of the container, the interior of the container was evacuated by a vacuum pump via an exhaust pipe. After the interior reached a sufficiently low pressure, a voltage was applied between element electrodes 27 and 28 of the electron-emitting elements 14 via outer container terminals Dx1 to Dxm and Dy1 to Dyn to perform electrification processing (forming processing) for conductive thin films 29, thereby forming electron-emitting portions 30. Forming processing was done by applying a voltage having a waveform shown in FIG. 8.

Acetone was introduced into the vacuum container to a pressure of 0.133 Pa via the exhaust pipe, and a voltage pulse was periodically applied to the outer container terminals Dx1 to Dxm and Dy1 to Dyn, thereby executing electrification activation processing of depositing carbon or a carbon compound. Electrification activation was done by applying a waveform as shown in FIG. 9.

While the entire airtight container was heated to 200° C., its interior was kept evacuated for 10 h. Then, the exhaust pipe was heated, welded, and sealed by a gas burner at a pressure of about $10^{-4}$ Pa.

Finally, getter processing was executed to maintain the pressure after sealing.

In the image forming apparatus completed in this way, a scan signal and a modulation signal serving as an image signal were applied from a signal generation means (not shown) to the respective electron-emitting elements 14 via the outer container terminals Dx1 to Dxm and Dy1 to Dyn, thereby emitting electrons. A high voltage was applied to the metal back 21 via the high-voltage terminal Hv to accelerate the emitted electron beam. The electrons collided with the fluorescent film 20 to excite fluorescent substances 20*b* and emit light, thus displaying an image. The application voltage Va to the high-voltage terminal Hv was 1 k to 5 kV, and the application voltage Vf between the element electrodes 27 and 28 was 14 V. Under these driving conditions, spacer sample S did not cause any beam deviation near the spacer 22, or, if any, caused a very small beam deviation, it did not impair a television image.

The $In_2O_3$ film of the first layer exhibited a temperature coefficient of resistance of −0.35%/° C. No thermal runaway occurred under these driving conditions.

Figure 17:
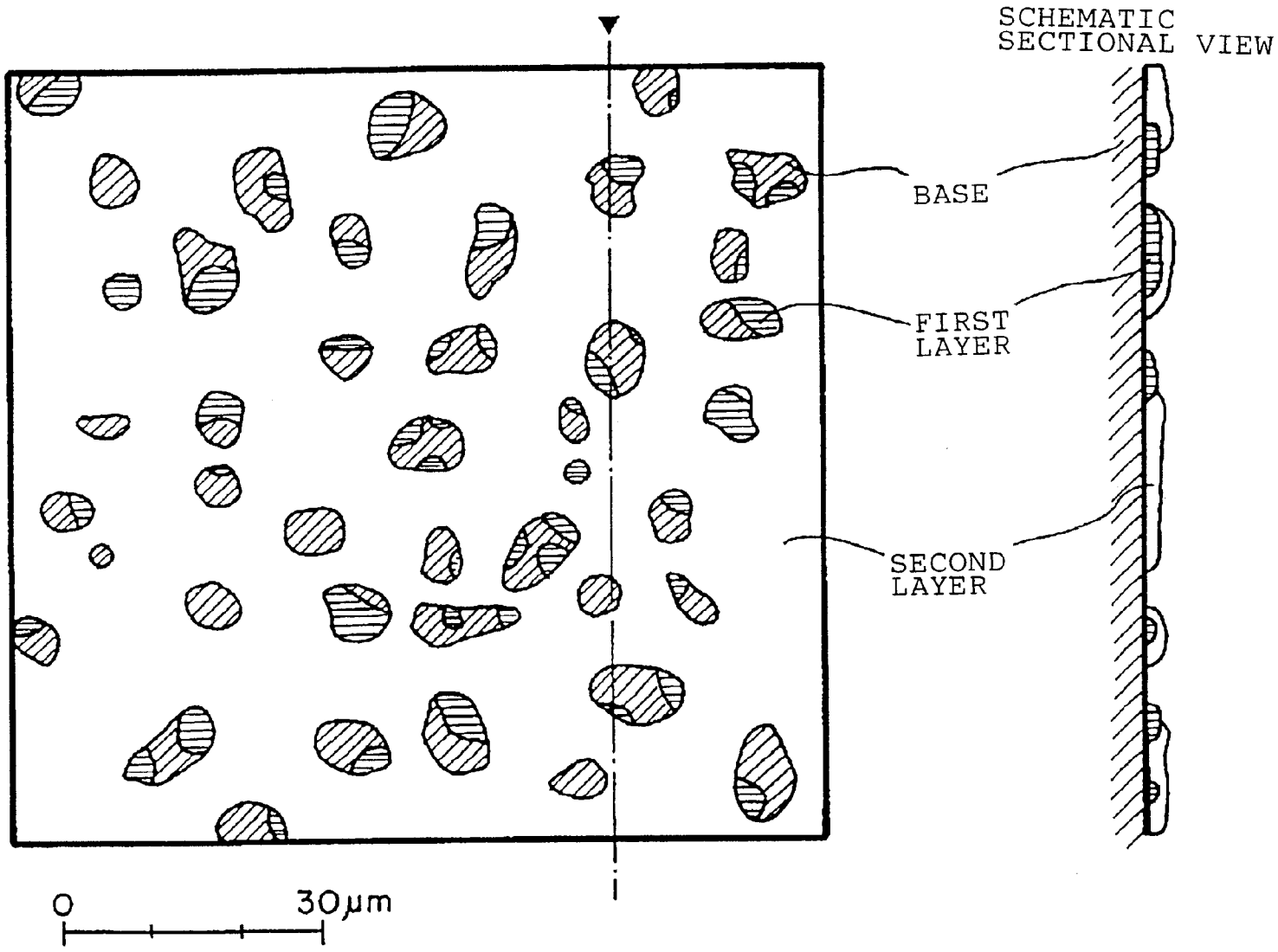
FIG. 17 shows a plan view and sectional view of a spacer used in the embodiment of the present invention.

FIG. 16 shows a conceptual plan view of this example, and FIG. 17 shows a plan view and sectional view of the spacer 22. The first layer 23*a* is formed with the network structure on the surface of the base 24, and the second layer 23*b* is formed with the network structure on the surfaces of the base 24 and first layer 23*a*. The surface of the spacer 22 was scanned within the range of 100 μm×100 μm with an AFM (Atomic Force Microscope) to confirm that a plurality of regions (recessed portions) surrounded by projecting portions having a height of 100 nm or more were distributively arranged within this range.

As a result, the first layer 23*a* exhibited a predetermined resistance value, and the first layer and second layer had an antistatic effect. Under these driving conditions, a high-quality image could be visually recognized without any beam deviation caused by charge of the spacer 22 near the spacer 22.

Example 2: Mixed State of Island Shape and Network Structure·Two Layers are Conductive In Example 2, an Au film of a first layer 23*a* was formed by a vacuum film formation method. The Au film used in this example was formed by sputtering in an argon atmosphere using a sputtering apparatus. Heat treatment was performed at 500° C. for 1 h to confirm a resistivity value.

Indium oxide of a second layer 23*b* was formed into a film on the first layer 23*a* by dipping, thereby obtaining sample T. After the substrate was dipped in a 10-time dilute solution of SYM-IN02 available from Kojundo Chemical Laboratory Co., Ltd., the substrate was pulled up at 20 mm/min, dried by an oven at 120° C. for 3 min, and baked at 450° C. for 2 h. The shapes of the films were observed with an SEM, and television images were compared using the obtained spacers. The film formation conditions and sample name of the sample are as follows.

(Sample B)

First Layer: Au, 5 nm, $3.1\times10^5$ Ωcm (after frit sealing step)

Film Formation Condition of First Layer:
- Application Power 140 W/cm$^2$
- Introduction Gas in Film Formation Ar, 0.5 Pa
- Film Formation Time 25 sec Film Shape of First Layer . . . Island Shape
- Width of Exposed Surface: 5 μm on average Second Layer: $In_2O_3$, 5 nm Film Formation Condition of Second Layer:
- Raw Material: SYM-IN02 was diluted 10 times with xylene.
- Pull-Up Speed: 20 mm/min
- Baking Condition: 450° C., 2 h Film Shape of Second Layer . . .
- Network Structure, Area of One
- Exposed Surface: 23 μm$^2$ on average Note that the resistivity of the spacer after the second layer 23*b* was formed was $1.0\times10^4$ Ωcm.

The subsequent assembly step was executed similarly to Example 1, and the sample was driven under the same conditions as in Example 1. Under these driving conditions, sample T did not cause any beam deviation near the spacer, or, if any, caused a very small beam deviation, it did not impair a television image.

Figure 18:
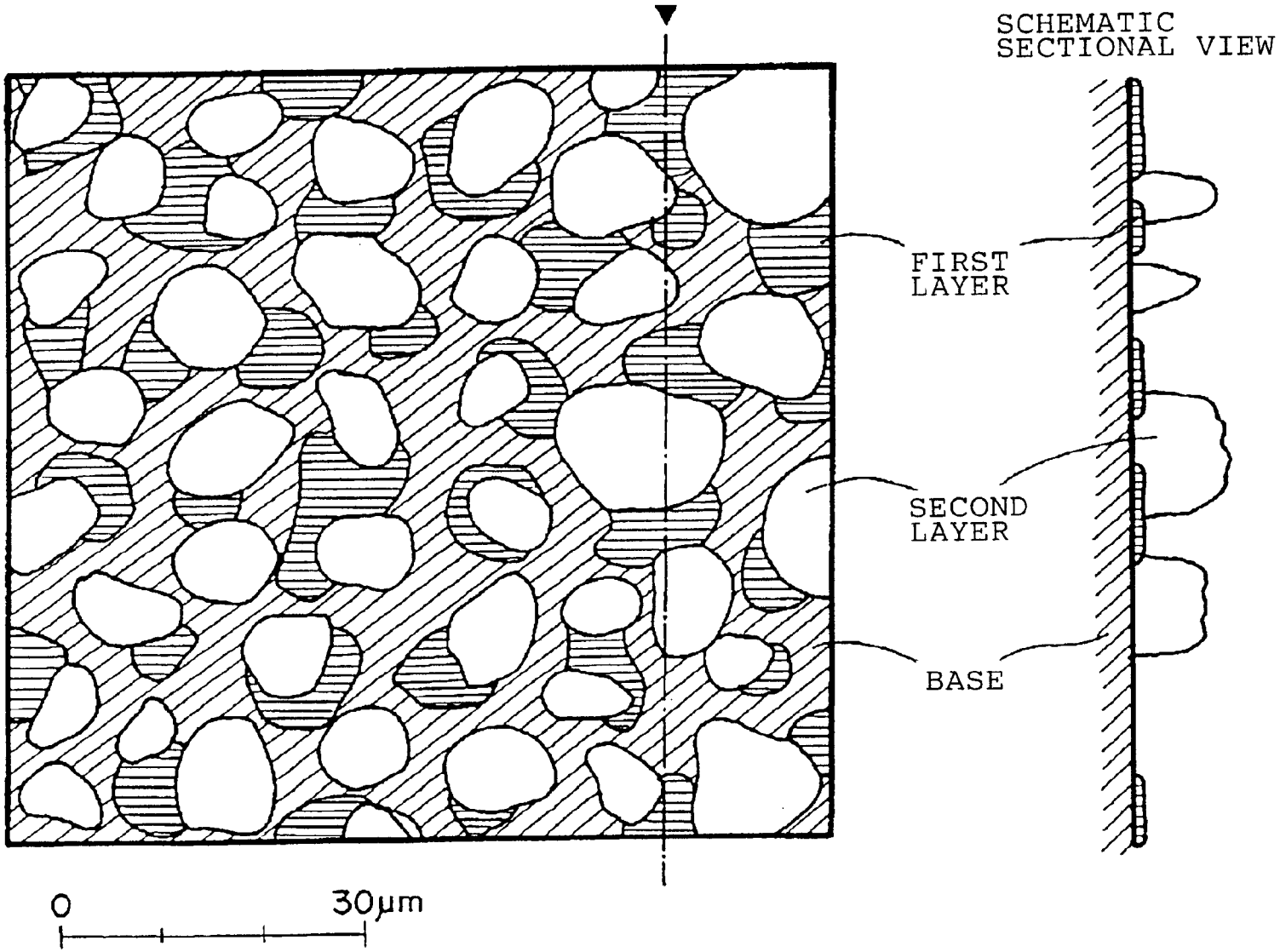
FIG. 18 shows a plan view and sectional view of a spacer used in the embodiment of the present invention.

FIG. 18 shows a conceptual plan view and sectional view of the spacer surface of this example. The island-like first layer 23*a* is formed on the surface of the base 24, and the second layer 23*b* with the network structure is formed on the surface of the first layer 23*a*. The first layer 23*a* exhibited a predetermined resistance value, and the first layer and second layer had an antistatic effect. Under these driving conditions, a high-quality image could be visually recognized without any beam deviation caused by charge of the spacer 22 near the spacer 22.

Example 3: Mixed State of Island Shape and Network Structure

In Example 3, Pt of a first layer 23*a* was formed into a film by the same method as for the first layer 23*a* of Example 2 except that the target of sputtering in Example 2 was replaced with Pt. Heat treatment was performed at 500° C. for 1 h to confirm a resistivity value.

Yttrium oxide of a second layer 23*b* was formed into a film on the first layer 23*a* by dipping, thereby obtaining samples U and W. After the substrate was dipped in a 2-time dilute solution or stock solution of SYM-Y01 available from Kojundo Chemical Laboratory Co., Ltd., the substrate was pulled up at 20 mm/min, dried by an oven at 120° C. for 3 min, and baked at 450° C. for 2 h. The shapes of the films were observed with an SEM, and television images were compared using the obtained spacers. The film formation conditions and sample names of the samples are as follows.

(Sample C)

First Layer: Pt, 5 nm (after frit sealing step), $2.0\times10^5$ Ωcm

Film Shape of First Layer . . .

Island Shape, Width of Exposed Surface: 7 μm on average

Second Layer: $Y_2O_3$, 400 nm

Film Formation Condition of Second Layer:

Raw Material: SYM-Y01 available from Kojundo Chemical Laboratory Co., Ltd. was diluted 2 times with xylene.

Pull-Up Speed: 20 mm/min

Baking Condition: 450° C., 2 h

Film Shape of Second Layer . . . Network Structure, Area of One Exposed Surface: 4 $\mu m^2$ on average (Sample D)

First Layer: Pt, 5 nm (after frit sealing step), $2.0\times10^5$ Ωcm

Film Shape of First Layer . . . Island Shape, Width of Exposed Surface: 7 μm on average Second Layer: $Y_2O_3$, 1.6 μm Film Formation Condition of Second Layer:

Raw Material: SYM-Y01 (stock solution)

Pull-Up Speed: 20 mm/min

Baking Condition: 450° C., 2 h

Film Shape of Second Layer . . . Mixture of Island Shape and Network Structure

The subsequent assembly step was executed similarly to Example 1, and the samples were driven under the same conditions as in Example 1. Under these driving conditions, samples U and W did not cause any beam deviation near the spacer, or, if any, caused a very small beam deviation, it did not impair a television image.

Example 4: Island Shape+Network Structure

In Example 4, a first layer 23*a* was formed by the same method as in Example 3, and chromium oxide of a second layer 23*b* was formed on the first layer 23*a* by a spinner method. After SYM-CR015 available from Kojundo Chemical Laboratory Co., Ltd. was applied by a spinner, the substrate was dried in an oven at 120° C. for 3 min, and baked at 500° C. for 1 h. The shapes of the films were observed with an SEM, and television images were compared using the obtained spacers. The film formation conditions and sample name of the sample are as follows.

(Sample E)

First Layer: Pt, 5 nm (after frit sealing step), $2.0\times10^5$ Ωcm

Film Shape of First Layer . . . Island Shape, Width of Exposed Surface: 7 μm on average Second Layer: $Cr_2O_3$, 20 nm Film Formation Condition of Second Layer:

Raw Material: SYM-CR015 available from Kojundo Chemical Laboratory Co., Ltd.

Rotational Speed: 500 rpm, 5 sec→3,500 rpm, 20 sec

Baking Condition: 500° C., 1 h

Figure 14:
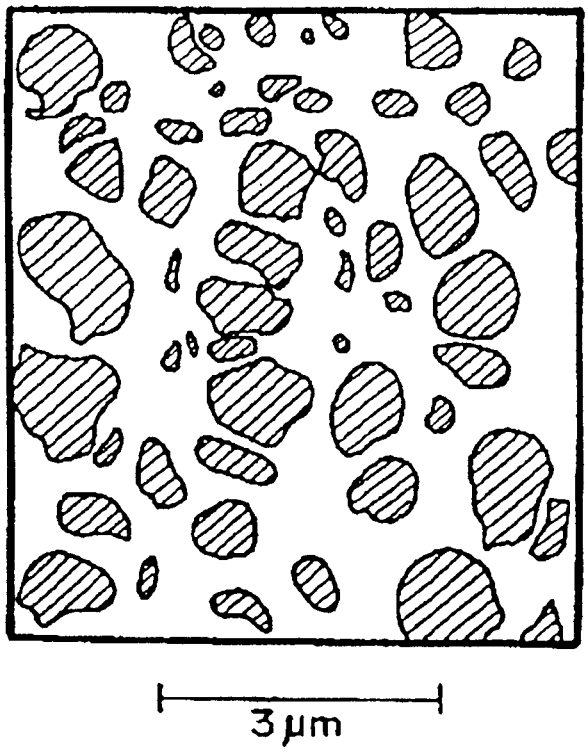
FIG. 14 is an enlarged view of a first layer or second layer with the network structure used in the embodiment of the present invention.
Figure 15:
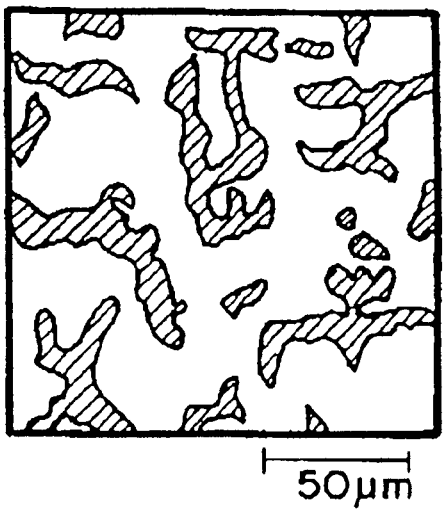
FIG. 15 is an enlarged view of a first layer or second layer with the network structure used in the embodiment of the present invention.

Film Shape of Second Layer . . . Network Structure (FIG. 14)

The subsequent assembly step was executed similarly to Example 1, and the sample was driven under the same conditions as in Example 1. Under these driving conditions, sample X did not cause any beam deviation near the spacer, or, if any, caused a very small beam deviation, it did not impair a television image.

Example 5

Examples 5 to 11 according to the present invention will be explained. Spacers and image forming apparatuses in Examples 5 to 11 were formed as follows.

In the following examples, the first layer was an almost flat film.

In this example, as shown in FIG. 1, a plurality of surface-conduction type electron sources 14 before forming were formed on a substrate 13. Soda-lime glass whose surface was cleaned was used as the substrate 13, and 160×720 surface-conduction type electron-emitting elements shown in FIGS. 4 and 5 were formed in a matrix on the substrate 13.

Element electrodes 24 and 25 were Pt sputtering films, and an X-direction wiring line 15 and Y-direction wiring line 16 were Ag wiring lines formed by a screen printing method. A conductive thin film 26 was a fine PdO particle film formed by baking a Pd amine complex solution.

As shown in FIG. 6(*a*), a fluorescent film 20 serving as an image forming member employed a stripe shape extending in the Y direction for fluorescent substances of the respective colors, and used a shape in which black members 20*a* were provided not only between fluorescent substances of the respective colors but also in the X direction so as to separate pixels in the Y direction and ensure portions where spacers 22 were to be arranged. The black members (conductive members) 20*a* were first formed, and then fluorescent substances of the respective colors were applied to gaps between the black members 20*a*, thereby forming the fluorescent film 20. The material of the black stripes (black members 20*a*) was a material mainly containing graphite that is generally used. A method of applying fluorescent substances to a face plate 19 was a slurry method.

A metal back 21 formed on an inner surface side (electron source side) from the fluorescent film 20 was formed by performing smoothing processing (generally called filming) for a surface of the fluorescent film 20 on the inner surface side after the fluorescent film 20 was formed, and evaporating Al in vacuum. In some cases, a transparent electrode may be formed on an outer surface side of the face plate 19 from the fluorescent film 20 in order to increase the conductivity of the fluorescent film 20. This example omitted such a transparent electrode because a satisfactory conductivity was obtained only by the metal back.

Figure 19:
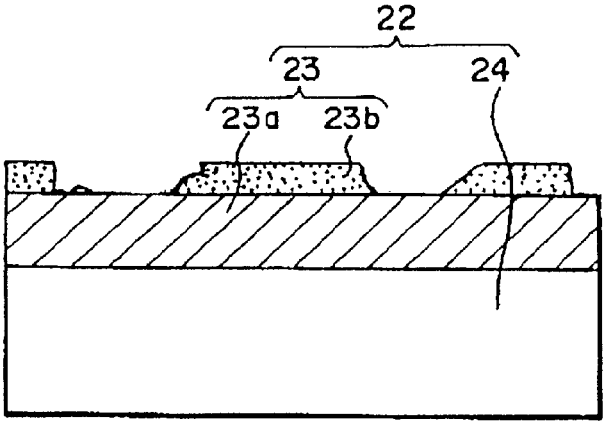
FIG. 19 is a schematic sectional view of a spacer used in the present invention.

In FIG. 19, the spacer 22 was prepared by forming a Cr—$Al_2O_3$ cermet film 23*a* by a vacuum film formation method on an insulating base 24 (height: 3.8 mm, thickness: 200 μm, length: 20 mm) made of cleaned soda-lime glass. The Cr—$Al_2O_3$ cermet film used in this example was formed by simultaneously sputtering Cr and $Al_2O_3$ targets in an argon atmosphere using a sputtering apparatus.

Argon was introduced into a film formation chamber (not shown) at 0.7 Pa, powers applied to the targets were changed to adjust the composition, and spacers having various resistance values were formed. Note that the resistivity value represents a value after heat treatment at 500° C. for 1 h.

After each of these samples was formed as a conductive film 23 of a first layer, yttrium oxide of a second layer was formed by dipping, thereby obtaining sample A. After the substrate was dipped in SYM-Y01 available from Kojundo Chemical Laboratory Co., Ltd., the substrate was pulled up at 20 mm/min, dried by an oven at 120° C. for 3 min, and baked at 450° C. for 2 h. Film formation was performed by the same method as for sample B and sample C. Then, heat treatment at 500° C. for 1 h described above was executed to complete the manufacture of the spacer 22. The film formation conditions and sample names of the samples are as follows.

Note that the material, film thickness, and resistivity are listed for the first layer, whereas the material, thickness, film formation conditions, and film shape are listed for the second layer. The film shape was observed with an AFM.

(Sample F)

First Layer: Cr—$Al_2O_3$, 200 nm, $1.2\times10^5$ Ωcm

Second Layer: $Y_2O_3$, 1.6 μm

Film Formation Condition of Second Layer . . .

Raw Material: SYM-Y01 Available from Kojundo Chemical Laboratory Co., Ltd.

Pull-Up Speed: 20 mm/min

Baking Condition: 450° C., 2 h

Figure 20:
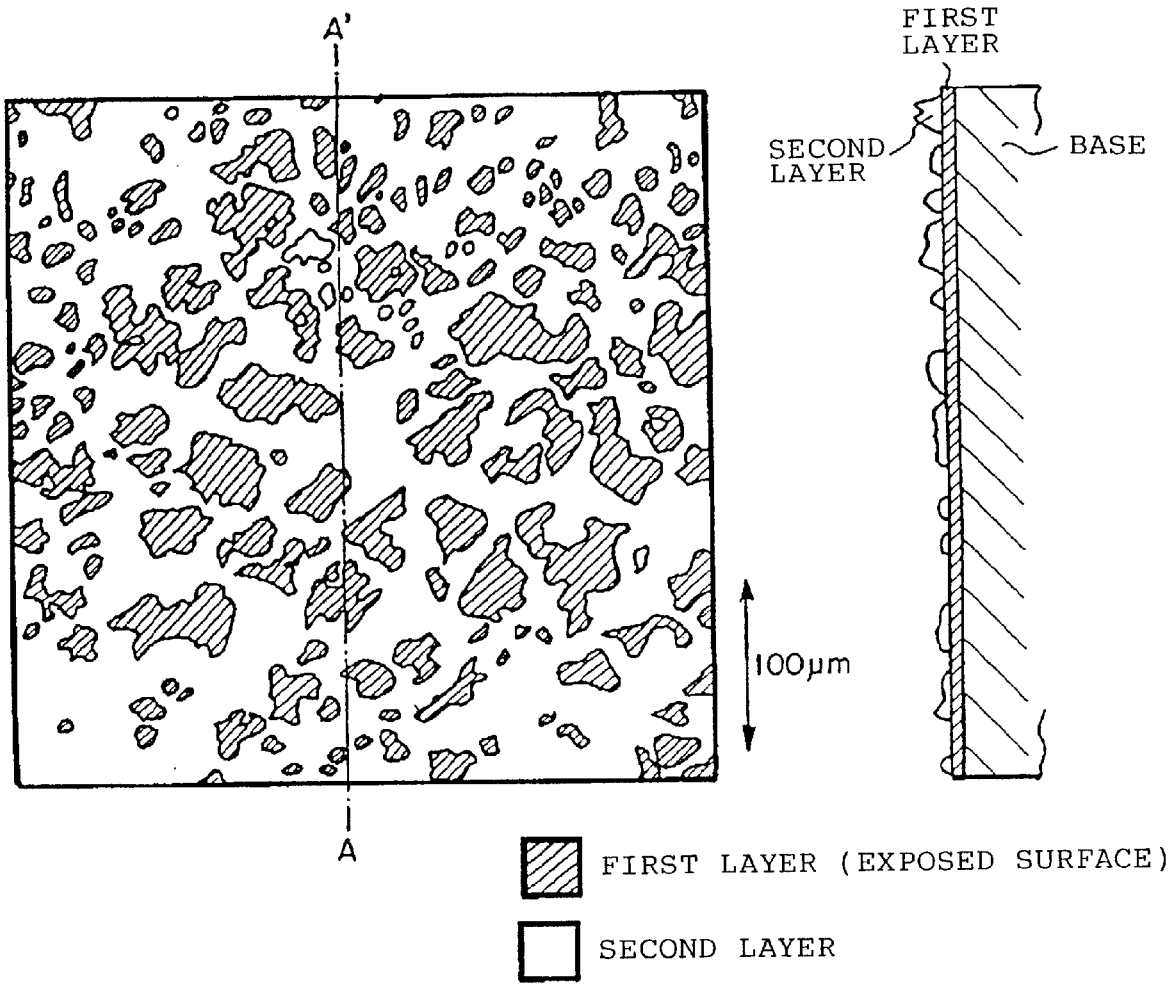
FIG. 20 shows enlarged views of a first layer or second layer with a structure in a mixed state of the network structure and island shape used in the embodiment of the present invention.
Figure 21:
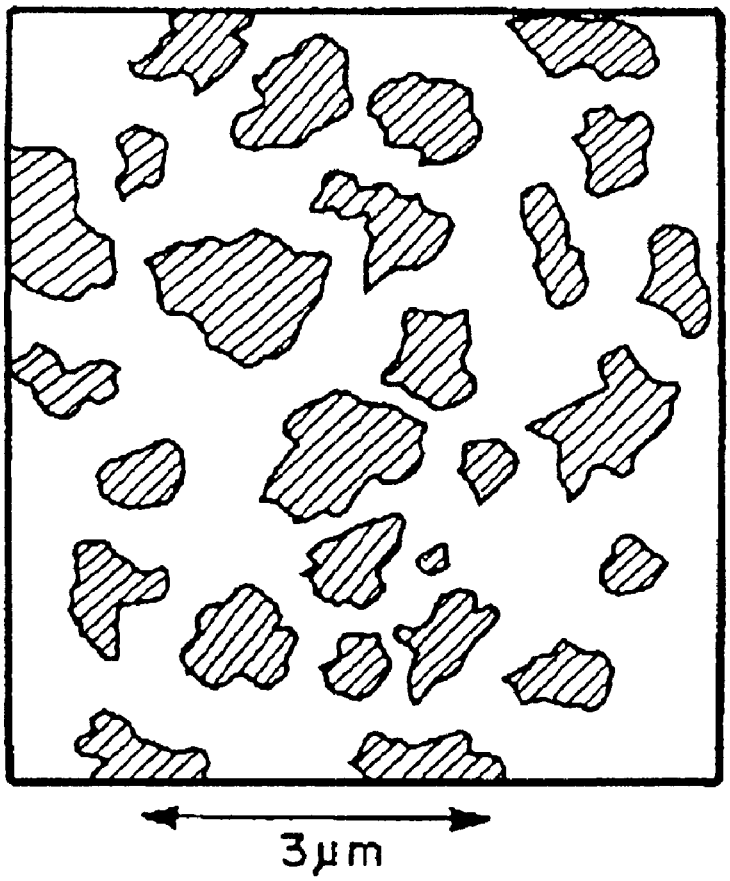
FIG. 21 is an enlarged view of a first layer or second layer with the network structure used in the embodiment of the present invention.

Film Shape of Second Layer . . . Mixture of Island Shape and Network Structure (FIG. 20)

(Sample G)

First Layer: Cr—$Al_2O_3$, 200 nm, $1.6\times10^5$ Ωcm

Second Layer: $CeO_3$, 500 nm

Film Formation Condition of Second Layer . . .

Raw Material: Needral Available from Taki Chemical Co., Ltd.

Pull-Up Speed: 50 mm/min

Baking Condition: 500° C., 1 h

Film Shape of Second Layer . . . Network Structure, Area of One Exposed Surface: 1.7 $\mu m^2$ on average Al electrodes 25 were formed at the connection portions of each spacer 22 in order to ensure electrical connection with the X-direction wiring line and metal back. The electrodes 25 completely covered the four surfaces of the spacer 22 within the range of 150 μm from the X-direction wiring line to the face plate and the range of 100 μm from the metal back to the rear plate.

After that, the face plate 19 was arranged 3.8 mm above the cold cathode electron-emitting element 14 via a support frame 18. Joint portions between the rear plate 13, face plate 19, support frame 18, and spacers 22 were fixed. The spacers 22 were fixed on the row-direction wiring lines 15 at an equal interval. On the face plate 19 side, the spacers 22 used conductive frit glass 26 containing silica balls covered with Au on the black members 20*a* (line width: 300 μm), and rendered antistatic films 23 and the face plate 19 conductive. Note that part of the metal back 21 was removed in a region where the metal back 21 was in contact with the spacers 22. Frit glass (not shown) was applied to a joint portion between the rear plate 17 and the support frame 18, and baked in the outer air at 420° C. for 10 min or more to seal the container.

Upon completion of the container, the interior of the container was evacuated by a vacuum pump via an exhaust pipe. After the interior reached a sufficiently low pressure, a voltage was applied between element electrodes 27 and 28 of the electron-emitting elements 14 via outer container terminals Dx1 to Dxm and Dy1 to Dyn to perform electrification processing (forming processing) for conductive thin films 29, thereby forming electron-emitting portions 30. Forming processing was done by applying a voltage having a waveform shown in Fig.

Acetone was introduced into the vacuum container to a pressure of 0.133 Pa via the exhaust pipe, and a voltage pulse was periodically applied to the outer container terminals Dx1 to Dxm and Dy1 to Dyn, thereby executing electrification activation processing of depositing carbon or a carbon compound. Electrification activation was done by applying a waveform as shown in FIG. 9.

While the entire container was heated to 200° C., its interior was kept evacuated for 10 h. Then, the exhaust pipe was heated, welded, and sealed by a gas burner at a pressure of about $10^{-4}$ Pa.

Finally, getter processing was executed to maintain the pressure after sealing.

In the image forming apparatus completed in this fashion, a scan signal and modulation signal were applied from a signal generation means (not shown) to the respective cold cathode electron-emitting elements 14 via the outer container terminals Dx1 to Dxm and Dy1 to Dyn, thereby emitting electrons. A high voltage was applied to the metal back 21 via the high-voltage terminal Hv to accelerate the emitted electron beam. The electrons collided with the fluorescent film 20 to excite fluorescent substances 20*b* and emit light, thus displaying an image. The application voltage Va to the high-voltage terminal Hv was 1 to 5 kV, and the application voltage Vf between the element electrodes 27 and 28 was 14 V. Under these driving conditions, spacer samples A and B did not cause any beam deviation near the spacer 22, or, if any, caused a very small beam deviation, it did not impair a television image.

The Cr—$Al_2O_3$ cermet film of the first layer exhibited a temperature coefficient of resistance of −0.3%/° C. to −0.33%/° C. No thermal runaway occurred under these driving conditions.

Example 6

In Example 6, a first layer was formed by the same method as in Example 5, and television images were compared using spacers having different film thicknesses of second layers. $Y_2O_3$ was used as the material of the second layer, and film formation was performed under the same film formation conditions as for sample E in Example 5. When the film thickness was set small, the stock solution was diluted with xylene, and when the film thickness was set large, processing from dipping to baking was repeated to adjust the film thickness. Formed samples are as follows.

(Sample H)

First Layer: Cr—Al—N, 200 nm, $1.8\times10^5$ Ωcm

Second Layer: $Y_2O_3$, 200 nm (SYM-Y01 was diluted 3 times.)

Film Shape of Second Layer . . . Network Structure (FIG. 20)

(Sample I)

First Layer: Cr—Al—N, 200 nm, $1.8\times10^5$ Ωcm

Second Layer: $Y_2O_3$, 400 nm (SYM-Y01 was diluted 2 times.)

Film Shape of Second Layer . . . Network Structure, Area of One Exposed Surface: 4 $\mu m^2$ on average)

The subsequent assembly step was executed similarly to Example 5, and the samples was driven under the same conditions as in Example 5. Under these driving conditions, samples D, E, and F did not cause any beam deviation near the spacer, or, if any, caused a very small beam deviation, it did not impair a television image.

Example 7

In Example 7, a Cr—$Al_2O_3$ cermet film was used as the material of a first layer 23*a*. A mixture of $Cr_2O_3$ and $Y_2O_3$ and a mixture of $Nb_2O_5$ and $Y_2O_3$ were used for a second layer 23*b*. More specifically, the mixture of $Cr_2O_3$ and $Y_2O_3$ was as a raw material a mixture of SYM-CR015 (available from Kojundo Chemical Laboratory Co., Ltd.) and SYM-Y01 at a ratio of 1:1, whereas the mixture of $Nb_2O_5$ and $Y_2O_3$ was as a raw material a mixture of SYM-NB05 (available from Kojundo Chemical Laboratory Co., Ltd.) and SYM-Y01 at a ratio of 1:1. Formed samples are as follows.

(Sample J)

First Layer: Cr—$Al_2O_3$, t=200 nm, R=$2.8\times10^5$ Ωcm

Second Layer: Mixture of $Cr_2O_3$ and $Y_2O_3$, 110 nm

Film Formation Condition of Second Layer . . . Pull-Up Speed: 10 mm/min Baking Condition: 500° C., 0.5 h Film Shape of Second Layer . . . Network Structure, Area of One Exposed Surface: 0.4 $\mu m^2$ on average (Sample K)

First Layer: Cr—$Al_2O_3$, t=200 nm, R=2.8×$10^5$ Ωcm

Second Layer: Mixture of $Nb_2O_5$ and $Y_2O_3$, 140 nm

Film Formation Condition of Second Layer . . . Pull-Up Speed: 10 mm/min Baking Condition: 500° C., 0.5 h Film Shape of Second Layer . . . Network Structure, Area of One Exposed Surface: 0.2 $\mu m^2$ on average The subsequent assembly step was driven under the same conditions as in Example 5. Under these driving conditions, sample J did not cause any beam deviation near the spacer, or, if any, caused a very small beam deviation, it did not impair a television image.

Example 8

In Example 8, similar to Example 7, a Cr—$Al_2O_3$ cermet film was used as the material of a first layer 23*a*, and a mixture of $Cr_2O_3$ and $Y_2O_3$ was used for a second layer 23*b*. Film formation was performed by the same film formation method as in Example 4 except that the coating method was changed from a dipping method to a spinner method and spraying method. Formed samples are as follows.

(Sample L)

First Layer: Cr—$Al_2O_3$, t=200 nm, R=2.8×$10^5$ Ωcm

Second Layer: mixture of $Cr_2O_3$ and $Y_2O_3$, 60 nm

Film Formation Condition of Second Layer . . .

Spinner Method: Rotational Speed 500 rpm, 5 sec→2, 000 rpm, 20 sec

Baking Condition: 500° C., 0.5 h

Film Shape of Second Layer . . . Network Structure, Area of Exposed Surface: 0.4 $\mu m^2$ on average (Sample M)

First Layer: Cr—$Al_2O_3$, t=200 nm, R=2.8×$10^5$ Ωcm

Second Layer: Mixture of $Cr_2O_3$ and $Y_2O_3$, 500 nm

Film Formation Condition of Second Layer . . . Spraying Method Baking Condition: 500° C., 0.5 h Film Shape of Second Layer . . . Mixed State of Island Shape and Network Structure, Width of Exposed Surface: 0.5 $\mu m$ on average The subsequent assembly step was driven under the same conditions as in Example 5. Under these driving conditions, samples K and L did not cause any beam deviation near the spacer, or, if any, caused a very small beam deviation, it did not impair a television image.

Example 9

In Example 9, a first layer was formed by the same method as that described in Example 5. Thereafter, while vacuum was maintained, a high-resistance layer 23*b* was formed as a second layer 23*b* on the first layer without extracting the substrate from the film formation apparatus. In this example, $Cr_2O_3$ will be exemplified. As a target, a $Cr_2O_3$ sintered body was used. After these samples were formed as first layers, the high-resistance films 23*b* were formed as the second layers 23*b* on the respective first layers while the film formation apparatus was kept in vacuum. In this example, three materials, i.e., $Cr_2O_3$, $Nb_2O_5$, and $Y_2O_3$ were selected as the material of the high-resistance film 23*b*. Film formation was done as follows. After a Cr—$Al_2O_3$ cermet film of the first layer was formed, a film of the second layer was formed without extracting the substrate from the vacuum chamber.

In this example, $Cr_2O_3$ will be exemplified. As a target, a $Cr_2O_3$ sintered body was used. Argon and oxygen were introduced into the film formation chamber at partial pressures of 0.4 Pa and 0.1 Pa, respectively. Application power to the target was set to 3.8 W/$cm^2$, the film formation time was set to 11 min, and a chromium oxide layer about 11 nm thick was obtained. Both $Nb_2O_5$ and $Y_2O_3$ were formed into films by the same method under different film formation conditions. Then, heat treatment at 500° C. for 1 h described above was executed to complete the manufacture of spacers 22. The film formation conditions and sample names of the samples are as follows.

(Sample N)

First Layer: Cr—$Al_2O_3$, 200 nm, 1.2×$10^5$ Ωcm

Second Layer: $Cr_2O_3$, 11 nm (after frit sealing step)

Figure 22:
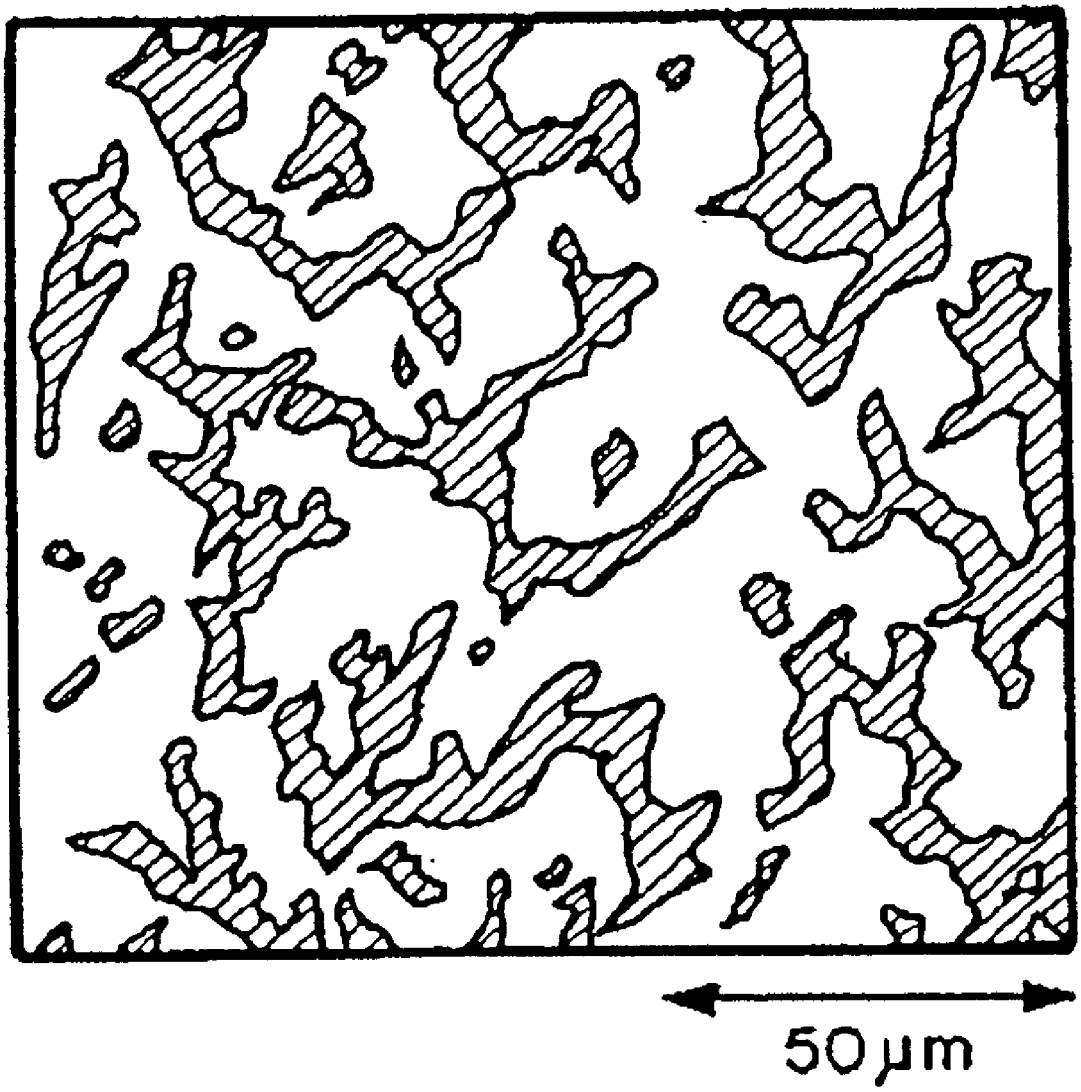
FIG. 22 is an enlarged view of a first layer or second layer with the island shape used in the embodiment of the present invention.
Figure 23:
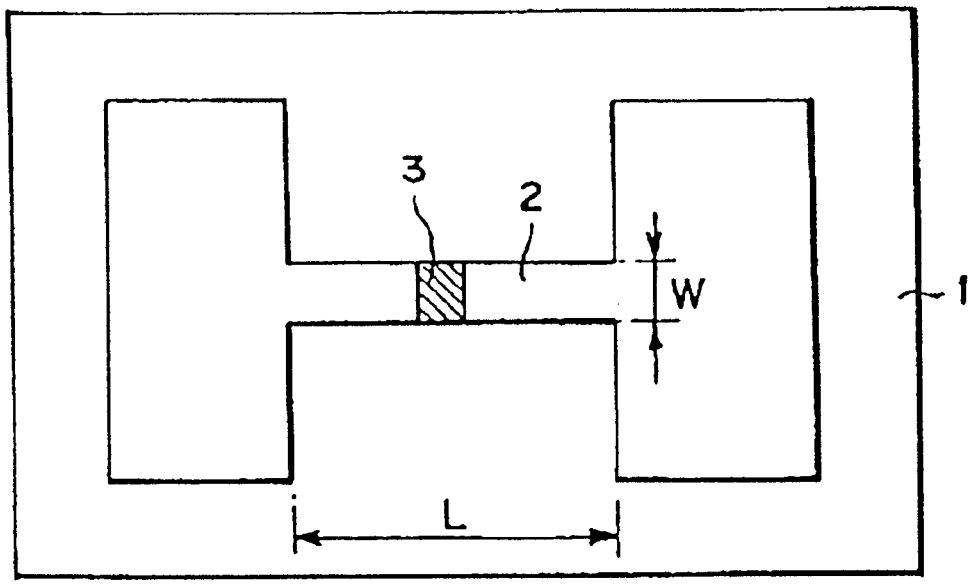
FIG. 23 is a view of an example of a conventionally known surface-conduction type electron-emitting element.
Figure 24:
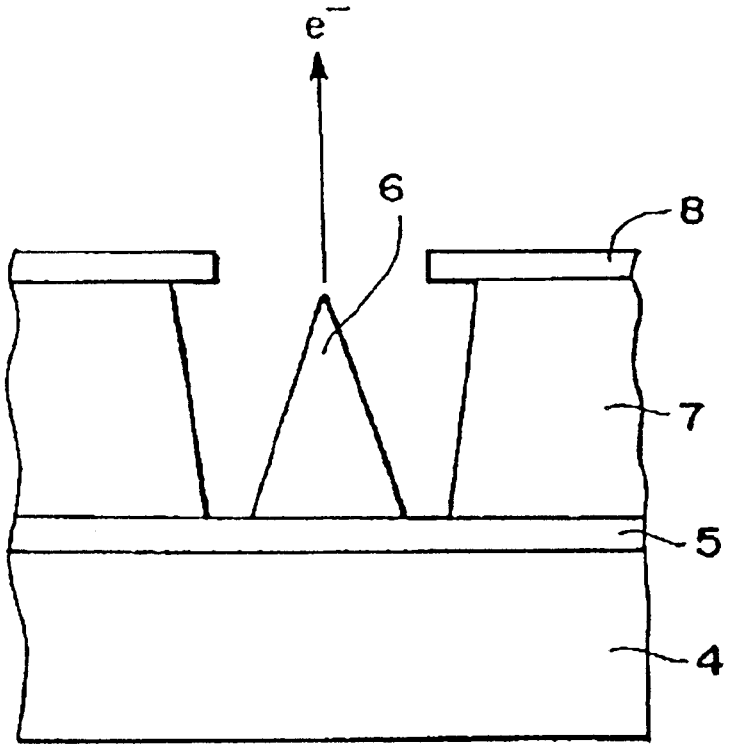
FIG. 24 is a view of an example of a conventionally known FE type element.
Figure 25:
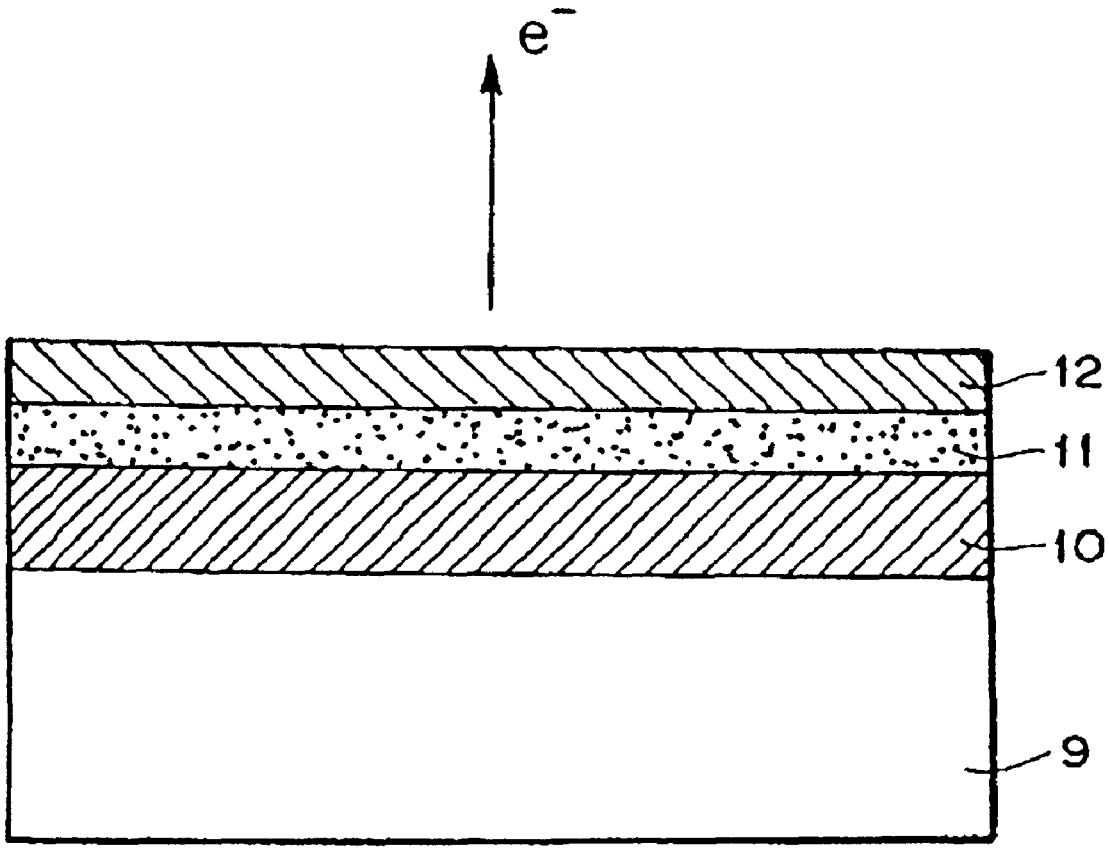
FIG. 25 is a view of an example of a conventionally known MIM type element.

Film Formation Condition of Second Layer . . . Application Power 3.8 W/$cm^2$ Introduction Gas in Film Formation Ar: 0.4 Pa $O_2$: 0.1 Pa Film Formation Time 11 min Film Shape of Second Layer . . . Network Structure (FIG. 22)

(Sample P)

First Layer: Cr—$Al_2O_3$, 200 nm, 1.6×$10^5$ Ωcm

Second Layer: $Nb_2O_5$, 10 nm (after frit sealing step) Island Shape

Film Formation Condition of Second Layer . . . Application Power 3.8 W/$cm^2$ Introduction Gas in Film Formation Ar: 0.4 Pa $O_2$: 0.1 Pa Film Formation Time 5 min Film Shape of Second Layer . . . Mixed State of and Network Structure and Island Shape, Area of Exposed Surface: 20 $\mu m$ on Average (Sample Q)

First Layer: Cr—$Al_2O_3$, 200 nm, 1.5×$10^5$ Ωcm

Second Layer: $Y_2O_3$, 12 nm (after frit sealing step)

Film Formation Condition of Second Layer . . . Application Power 3.8 W/$cm^2$ Introduction Gas in Film Formation Ar: 0.27 mTorr $O_2$: 0.18 Pa Film Formation Time 15 min Film Shape of Second Layer . . . Network Structure Area of Exposed Surface: 1,500 $\mu m^2$ on Average The subsequent assembly step was performed similarly to Example 5, and the samples were driven under the same conditions as in Example 5. Under these driving conditions, samples M, N, and P did not cause any beam deviation near the spacer, or, if any, caused a very small beam deviation, it did not impair a television image.

As has been described by way of examples, the invention of the present application can preferably suppress charge by giving the network structure to the spacer. As described in the examples, the spacer can be made up of two layers, which can increase choice of the material, the degree of freedom of the manufacturing method, and ease of manufacturing. Industrial Applicability As has been described above, the electron beam device and the method of producing a charging-suppressing member used in the apparatus according to the present invention can be applied to a large-screen, thin display panel such as a wall-mounted television called a flat panel display, and its manufacturing process. The spacer for keeping the interior of the airtight container at a very low atmospheric pressure can maintain a high-quality image free from any charge or discharge in the container for a long time.

What is claimed is:

1. An electron beam device having an electron source for emitting electrons, a member to be irradiated with the electrons, and a first member interposed between the electron source and the member to be irradiated, characterized in that a surface of the first member has a three-dimensional shape, and projecting portions of the three-dimensional shape form a network shape, wherein when a section of said three-dimensional shape is viewed along two axes extending perpendicularly to each other in any direction along the surface of the first member, recesses and projections are present along both said axes.

2. An electron beam device according to claim 1, wherein the three-dimensional shape is constituted by a film formed on a substrate of the first member.

3. An electron beam device according to claim 2, wherein the three-dimensional shape is constituted by a plurality of films formed on a substrate of the first member.

4. An electron beam device according to claim 1, wherein the three-dimensional shape is constituted by a plurality of films formed on a substrate of the first member.

5. An electron beam device according to claim 1, wherein the first member includes a spacer for maintaining an interval between the electron source and the member to be irradiated.

6. An electron beam device according to claim 1, wherein the first member includes a member arranged at a position which, when the first member is charged, substantially changes by charge an orbit of electrons emitted by the electron source.

7. An electron beam device according to claim 1, wherein the first member is fixed to the electron source.

8. An electron beam device according to claim 1, wherein the first member is fixed to an inner side of the member to be irradiated.

9. An electron beam device according to claim 1, wherein a fluorescent substance is formed on the member to be irradiated.

10. An electron beam device having an electron source for emitting electrons, a member to be irradiated with the electrons, and a first member interposed between the electron source and the member to be irradiated, characterized in that a surface of the first member has a three-dimensional shape, and the three-dimensional shape has recessed portions continuously surrounded by projecting portions, wherein when a section of said three-dimensional shape is viewed along two axes extending perpendicularly to each other in any direction along the surface of the first member, recesses and projections are present along both said axes.

11. An electron beam device according to claim 10, wherein the projecting portion has a height of at least not less than 100 nm from a deepest portion of the recessed portion.

12. An electron beam device according to claim 11, wherein the three-dimensional shape is constituted by a film formed on a substrate of the first member.

13. An electron beam device according to claim 11, wherein the three-dimensional shape is constituted by a plurality of films formed on a substrate of the first member, wherein the recessed portions and projection portions are present on the surface of the first member.

14. An electron beam device according to claim 10, wherein the three-dimensional shape is constituted by a film formed on a substrate of the first member.

15. An electron beam device according to claim 10, wherein the three-dimensional shape is constituted by a plurality of films formed on a substrate of the first member, wherein the recessed portions and projection portions are present on the surface of the first member.

16. An electron beam device according to claim 10, wherein the three-dimensional shape is constituted by a first film formed on a substrate of the first member and a second film from which part of an underlayer of the first film is exposed.

17. An electron beam device according to claim 16, wherein the underlayer of the first film from which part of the underlayer is exposed is conductive.

18. An electron beam device according to claim 16, wherein the first member has a 100 $\mu$m×100 $\mu$m-region in which a value obtained by dividing a covering area of the first film from which part of the underlayer is exposed by an exposure area of the underlayer is not less than ⅓ and not more than 100.

19. An electron beam device according to claim 16, wherein the first member has a 100 $\mu$m×100 $\mu$m-region in which an average value of an area of each portion from which part of the underlayer is exposed is not more than 5,000 $\mu m^2$.

20. An electron beam device according to claim 16, wherein the first member has a 100 $\mu$m×100 $\mu$m-region in which an average value of a width of each portion from which part of the underlayer is exposed is not more than 70 $\mu$m.

21. An electron beam device according to claim 16, wherein the first film from which part of the underlayer is exposed includes an insulating film.

22. An electron beam device according to claim 16, wherein a secondary electron emission coefficient of the second film from which part of the underlayer is exposed is smaller than a secondary electron emission coefficient of the underlayer.

23. An electron beam device having an electron source for emitting electrons, a member to be irradiated with the electrons, and a first member interposed between the electron source and the member to be irradiated, characterized in that a surface of the first member has a three-dimensional shape, and projecting portions of the three-dimensional shape form a network shape, wherein the three-dimensional shape is constituted by a first film formed on a substrate of the first member and a second film from which part of the underlayer of the first film is exposed.

24. An electron beam device according to claim 23, wherein the underlayer of the first film from which part of the underlayer is exposed is conductive.

25. An electron beam device according to claim 24, wherein the first member has a 100 $\mu$m×100 $\mu$m-region in which a value obtained by dividing a covering area of the first film from which part of the underlayer is exposed by an exposure area of the underlayer is not less than ⅓ and not more than 100.

26. An electron beam device according to claim 24, wherein the first member has a 100 $\mu$m×100 $\mu$m-region in which an average value of an area of each portion from which part of the underlayer is exposed is not more than 5,000 $\mu m^2$.

27. An electron beam device according to claim 24, wherein the first member has a 100 $\mu$m×100 $\mu$m-region in which an average value of a width of each portion from which part of the underlayer is exposed is not more than 70 $\mu$m.

28. An electron beam device according to claim 24, wherein the first film from which part of the underlayer is exposed includes an insulating film.

29. An electron beam device according to claim 24, wherein a secondary electron emission coefficient of the second film from which part of the underlayer is exposed is smaller than a secondary electron emission coefficient of the underlayer.

30. An electron beam device having an electron source for emitting electrons, a member to be irradiated with the electrons, and a first member interposed between the electron source and the member to be irradiated has a three-dimensional shape, and the three-dimensional shape has recessed portions continuously surrounded by projecting portions, wherein the projecting portion has a height of at a least not less than 100 nm from a deepest portion of the recessed portion and wherein the three-dimensional shape is constituted by a first film formed on a substrate of the first member and a second film from which part of an underlayer of the first film is exposed.

31. An electron beam device according to claim 30, wherein the underlayer of the first film from which part of the underlayer is exposed is conductive.

32. An electron beam device according to claim 30, wherein the first member has a 100 $\mu$m×100 $\mu$m-region in which a value obtained by dividing a covering area of the first film from which part of the underlayer is exposed by an exposure area of the underlayer is not less than ⅓ and not more than 100.

33. An electron beam device according to claim 30, wherein the first member has a 100 $\mu$m×100 $\mu$m-region in which an average value of an area of each portion from which part of the underlayer is exposed is not more than 5,000 $\mu m^2$.

34. An electron beam device according to claim 30, wherein the first member has a 100 $\mu$m×100 $\mu$m-region in which an average value of a width of each portion from which part of the underlayer is exposed is not more than 70 $\mu$m.

35. An electron beam device according to claim 30, wherein the first film from which part of the underlayer is exposed includes an insulating film.

36. An electron beam device according to claim 30, wherein a secondary electron emission coefficient of the second film from which part of the underlayer is exposed is smaller than a secondary electron emission.

37. An electron beam device having an electron source for emitting electrons, a member to be irradiated with the electrons, and a first member interposed between the electron source and the member to be irradiated, characterized in that a surface of the first member has a three-dimensional shape, and projecting portions of the three-dimensional shape form a network shape, wherein the three-dimensional shape is constituted by a first film formed on a substrate of the first member and a second film from which part of an underlayer of the first film is exposed.

38. An electron beam device according to claim 37, wherein the underlayer of the first film from which part of the underlayer is exposed is conductive.

39. An electron beam device according to claim 37, wherein the first member has a 100 $\mu$m×100 $\mu$m-region in which a value obtained by dividing a covering area of the first film from which part of the underlayer is exposed by an exposure area of the underlayer is not less than ⅓ and not more than 100.

40. An electron beam device according to claim 37, wherein the first member has a 100 $\mu$m×100 $\mu$m-region in which an average value of an area of each portion from which part of the underlayer is exposed is not more than 5,000 $\mu m^2$.

41. An electron beam device according to claim 37, wherein the first member has a 100 $\mu$m×100 $\mu$m-region in which an average value of a width of each portion from which part of the underlayer is exposed is not more than 70 $\mu$m.

42. An electron beam device according to claim 37, wherein the first film from which part of the underlayer is exposed includes an insulating film.

43. An electron beam device according to claim 37, wherein a secondary electron emission coefficient of the second film from which part of the underlayer is exposed is smaller than a secondary electron emission coefficient of the underlayer.

44. An electron beam device having an electron source for emitting electrons, a member to be irradiated with the electrons, and a first member interposed between the electron source and the member to be irradiated, characterized in that a surface of the first member has a three-dimensional shape, and the three-dimensional shape has recessed portions, wherein the three-dimensional shape is constituted by a first film formed on a substrate of the first member and a second film from which part of an underlayer of the first film is exposed.

45. An electron beam device according to claim 44, wherein the underlayer of the first film from which part of the underlayer is exposed is conductive.

46. An electron beam device according to claim 44, wherein the first member has a 100 $\mu$m×100 $\mu$m-region in which a value obtained by dividing a covering area of the first film from which part of the underlayer is exposed by an exposure area of the underlayer is not less than ⅓ and not more than 100.

47. An electron beam device according to claim 44, wherein the first member has a 100 $\mu$m×100 $\mu$m-region in which an average value of an area of each portion from which part of the underlayer is exposed is not more than 5,000 $\mu m^2$.

48. An electron beam device according to claim 44, wherein the first member has a 100 $\mu$m×100 $\mu$m-region in which an average value of a width of each portion from which part of the underlayer is exposed is not more than 70 $\mu$m.

49. An electron beam device according to claim 44, wherein the first film from which part of the underlayer is exposed includes an insulating film.

50. An electron beam device according to claim 44, wherein a secondary electron emission coefficient of the second film from which part of the underlayer is exposed is smaller than a secondary electron emission coefficient of the underlayer.

51. An image forming apparatus having a structure in which a substrate having a plurality of electron-emitting elements and a transparent substrate having a light-emitting material face each other via a spacer characterized in that:

a surface of the spacer has a three-dimension shape, and projecting portions of the three-dimensional shape form a network shape, wherein when a section of said network shape is viewed along two axes extending perpendicularly to each other in any direction along the surface of the spacer, recesses and projections are present along both said axes.

* * * * *

UNITED STATES PATENT AND TRADEMARK OFFICE

CERTIFICATE OF CORRECTION

PATENT NO. : 6,657,368 B1
DATED : December 2, 2003
INVENTOR(S) : Yoko Kosada et al.

It is certified that error appears in the above-identified patent and that said Letters Patent is hereby corrected as shown below:

Column 3,
Line 56, “of” should read -- of the --.

Column 13,
Line 14, “film 23” should read -- film 23a --.

Column 16,
Line 13, “conduction.” should read -- conduction --.

Column 27,
Line 52, “Fig.” should read -- Fig. 8 --.

Column 28,
Line 42, “average)” should read -- average --.

Column 30,
Lines 30 and 40, “Average” should read -- average --.

Column 33,
Line 4, “a” (second occurrence) should be deleted; and
Line 6, “portion” should read -- portion, --.

Column 34,
Line 53, “three-dimension” should read -- three-dimensional --.

Signed and Sealed this

Twenty-second Day of June, 2004

JON W. DUDAS
*Acting Director of the United States Patent and Trademark Office*